US007145528B2

(12) United States Patent
Yabu et al.

(10) Patent No.: US 7,145,528 B2
(45) Date of Patent: Dec. 5, 2006

(54) DISPLAY DEVICE AND DRIVING AND CONTROLLING METHOD THEREFOR

(75) Inventors: Shigeki Yabu, Kanagawa (JP); Takeo Tsukamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 610 days.

(21) Appl. No.: 10/716,664

(22) Filed: Nov. 20, 2003

(65) Prior Publication Data

US 2004/0130539 A1 Jul. 8, 2004

(30) Foreign Application Priority Data

Nov. 21, 2002 (JP) ..... 2002-337943

(51) Int. Cl.
*G09G 3/30* (2006.01)
*G09G 1/04* (2006.01)
*H01J 29/70* (2006.01)

(52) U.S. Cl. ..... 345/75.2; 315/366; 313/422

(58) Field of Classification Search ..... 345/10, 345/55, 73, 74.1, 75.1, 75.2; 315/3, 169.1, 315/366; 313/302, 422, 495
See application file for complete search history.

(56) References Cited

U.S. PATENT DOCUMENTS 5,272,419 A * 12/1993 Park ..... 315/169.1
5,563,624 A 10/1996 Imamura ..... 345/100
5,589,738 A * 12/1996 Onodaka et al. ..... 315/169.1
5,592,191 A 1/1997 Tsuboyama et al. ..... 345/97
5,627,436 A * 5/1997 Suzuki et al. ..... 315/169.1
6,400,091 B1 6/2002 Deguchi et al. ..... 315/169.1
6,437,503 B1 8/2002 Konuma ..... 313/495
2002/0047513 A1 4/2002 Nomura ..... 313/495
2002/0074947 A1 6/2002 Tsukamoto ..... 315/169.3

FOREIGN PATENT DOCUMENTS

JP 2000-243218 9/2000
JP 2002-150925 5/2002
JP 2002-170483 6/2002
JP 2003-228316 8/2003

OTHER PUBLICATIONS

C.A. Spindt, et al., "Physical Properties of Thin-Film Field Emission Cathodes with Molybdenum Cones", J. Appl. Phys., vol. 47, No. 12, pp. 5248-5263 (Dec. 1976).
C.A. Meade, "Operation of Tunnel-Emission Devices", J. Appl. Phys. vol. 32, No. 4, pp. 646-652, (1961).
M. I. Elinson, et al., "The Emission of Hot Electrons and the Field Emission of Electrons from Tin Oxide", Radio Eng. Electron Phys. vol. 10, pp. 1290-1296, (Jul. 1965).

* cited by examiner

*Primary Examiner*—Richard Hjerpe
*Assistant Examiner*—Kevin M. Nguyen
(74) *Attorney, Agent, or Firm*—Fitzpatrick, Cella, Harper & Scinto

(57) ABSTRACT

In a display device and a driving and controlling method therefor, in order to restrain the occurrence of an unsatisfactory display state or unsatisfactory luminescence in the case where an anode potential is made to transition from a supply state to a cut-off state in response to the generation of a display completing signal, when a display signal DS is generated at time t0, an anode potential Va is raised at time t1, and at time t2 until which a predetermined time Td2 passes after the anode potential Va decreases below a threshold potential Vth with a cut-off voltage applied between cathodes and an anode, the application of the cut-off voltage is completed.

14 Claims, 15 Drawing Sheets

DISPLAY DEVICE AND DRIVING AND CONTROLLING METHOD THEREFOR

BACKGROUND OF THE INVENTION

1. Field of the Invention

The invention relates to a display device for use in a computer monitor, a television set or the like, and more particularly, to a display device including a display panel which has three kinds of terminals, i.e., an anode, cathodes and gates, the cathodes and the gates being connected in matrix form.

2. Description of Related Art

In recent years, flat-panel display devices using electron emission elements have been attracting more and more attention.

There are a hot-cathode type of electron emission element and a cold-cathode type of electron emission element. The display panels for flat-panel display devices mainly employ electron emission elements of the cold-cathode type, and a field emission type (hereinafter referred to as the FE type), a metal/insulator/metal type (hereinafter referred to as the MIM type), a surface conduction type (hereinafter referred to as the SC type) and the like are known.

A famous example of the FE type is disclosed in C. A. Spindt, "Physical properties of thin-film field emission cathodes with molybdenum cones", J. Appl. Phys., 47, 5248 (1976). A known example of the MIM type is disclosed in C. A. Mead, "Operation of Tunnel-Emission Devices", J. Appl. Phys., 32, 646 (1961). A known example of the SC type is disclosed in M. I. Elinson, Radio Eng. Electron Phys., 10, 1290 (1965)

To realize a display panel by using these electron emission elements as its electron sources, there are provided a substrate on which cathodes and gates are formed to be connected in XY matrix form, and an anode having a phosphor layer arranged in opposition to the substrate. The display panel is constructed to irradiate electrons emitted from the electron emitters of the cathodes onto the phosphor layer on the anode and cause the phosphor layer to emit light.

As such electron emission elements, fibrous electron emitters or carbon-based materials which are small in work function for electron emission and are low in threshold voltage are attracting attention, and examples using these electron emission elements are disclosed in Patent Documents 1 to 3.

Any of these examples employs fullerene, diamond, diamond-like carbon (DLC), carbon nanotubes (CNT), fibrous carbon and the like as electron emitters.

In the case of an electron emitter which is low in threshold voltage and uses three kinds of terminals, electrons are emitted from the electron emitter provided on the cathode by field electron emission, merely by applying a normal high voltage (anode voltage) between the anode and the cathode without applying a voltage between the cathode and the gate. Accordingly, it is possible to realize a construction which, during emission, performs electron emission without applying a voltage between the cathode and the gate and, during non-emission, restrains electron emission by applying a cut-off voltage (stop voltage) between the cathode and the gate. This operation will be hereinafter referred to as the normally-on type.

A single electron emission element of the normally-on type employing a carbon fiber electron emitter will be described below.

FIGS. 15A and 15B are diagrammatic views showing different potential distributions of the single electron emission element, and FIG. 15A shows a potential distribution appearing during a driven state in which electrons are being emitted, while FIG. 15B shows a potential distribution appearing during a cut-off state in which electron emission is stopped.

The state shown in FIG. 15A is the driven state in which an electric field larger than a threshold electric field with which electron emission is started is generated for an electron emitter 5 on a cathode 2 by only the voltage between a cathode 2 and an anode 6, thereby causing electron emission. This state is called a normally-on state.

For example, if the threshold electric field of the electron emitter 5 is 3 V/μm, in the case where the anode 6 is provided at a position separated from the cathode 2 by a distance of 2 mm, electron emission is started by applying a voltage of 0 V to the cathode 2 and an anode voltage of 6 kV between the cathode 2 and the anode 6.

Incidentally, a far higher anode voltage may also be applied to realize a suitable normally-on state, and the anode voltage may be determined by an electric field strength capable of providing the required current density, according to the voltage-current characteristics of the electron emission element.

For example, if the required current density can be obtained with an electric field strength of 5 V/μm, an anode voltage of 10 kV may be applied in the case where the anode 6 is provided at a position separated from the cathode 2 by a distance of 2 mm.

FIG. 15A shows the state of equipotential surfaces. In FIG. 15A, equipotential surfaces are nearly uniformly present between the anode 6 and the electron emitter 5, and an electric field strength near the electron emitter 5 is about 5 V/μm, whereby electron emission occurs.

In addition, a voltage to be applied between the cathode 2 and a gate 4 for the purpose of electron emission may be any potential that does not influence the electric field strength due to the anode voltage. Incidentally, FIG. 15A shows an example in which the voltage is set to 0 V in the normally-on state.

On the other hand, during the state shown in FIG. 15B, when a negative potential relative to the cathode 2 is supplied to the gate 4, an electric field strength which the vicinity of the electron emitter 5 receives from the anode 6 becomes small. Accordingly, the electric field strength becomes less than the threshold electric field required for electron emission, whereby electron emission stops. The voltage between the cathode 2 and the gate 4 at this time is called a cut-off voltage.

The equipotential surfaces obtained when the cut-off voltage is applied between the cathode 2 and the gate 4, as shown in FIG. 15B, are 0 V at the cathode 2 and the electron emitter 5, and the gate 4 is at a negative potential. Accordingly, the space between the equipotential surfaces near the electron emitter 5 becomes wide, so that the electric field strength becomes small.

Incidentally, the cut-off voltage applied between the cathode 2 and the gate 4 at this time is suitably determined by the electric field strength required to stop electron emission, and the design of the dimensions of the electron emitter 5, a cathode-gate distance, the dimensions of the gate and the like. The electric field strength required to stop electron emission is determined by the threshold electric field of the electron emitter 5 and the anode voltage relative to the normally-on state.

As described above, in the normally-on type of electron emission element, electron emission is performed by only the application of a voltage between the cathode and the anode. In addition, electron emission is controlled by applying the cut-off voltage between the cathode and the gate and cutting off the electron emission. Accordingly, the voltage between the cathode and the gate need not be made higher than the threshold required for electron emission, whereby low-voltage stable driving control can be realized.

Proposals are made with respect to the art of applying such a normally-on type of electron emission element to an XY matrix type of flat-panel display device. In the case of this type of flat-panel display device, a voltage capable of giving an electric field strength not lower than the threshold of electron emission is applied between the cathodes and the anodes, and while the cut-off voltage is not being applied between the cathodes and the gates, full-screen white display is performed at the maximum luminance on the entire display screen.

Accordingly, in the case where this flat-panel display device is used in a television set or a computer monitor, if full-screen white display is performed even for a short time, a user often mistakes such white display for a failure of the display device or feels uncomfortable.

Particularly when display is completed, for example, when the power source of the display device body is turned off, or when the display device transfers from a display mode to a power-saving non-display mode, or when the power source is shut off by a power failure, even if the anode potential is immediately cut off, the anode potential does not sharply decrease, because electric charge is accumulated on the anode. In addition, since the application of the cut-off voltage is also stopped at this time, the display device continues electron emission until the anode potential decreases below the threshold. Accordingly, during the end period of display, the display device performs full-screen white display at the maximum luminance until the anode potential decreases below the threshold.

SUMMARY OF THE INVENTION

An object of the invention is to provide a display device and a driving and controlling method therefor, both of which are capable of restraining the occurrence of an unsatisfactory display state and unsatisfactory luminescence in the case where an anode potential is made to transition from a supply state to a cut-off state in response to the occurrence of a display completing signal.

Another object of the invention is to provide a display device such as an XY matrix type of flat-panel display which uses, as its cathodes, electron sources having a threshold capable of causing electron emission with an anode voltage applied between the cathodes and an anode, and controls display by applying a cut-off voltage (stop voltage) between the cathodes and gates provided in the vicinity of the cathodes, the display device including a control unit which performs control to stop the application of a predetermined control voltage between the cathodes and the gates after applying an anode voltage so that an average electric field strength generated by at least the anode voltage becomes smaller than the threshold of the electron sources, after a display completing signal is generated, as when a power source is cut off.

Another object of the invention is to provide a display device which includes: a display panel having cathodes, gates and an anode, the cathodes and the gates being connected in matrix form; electron emitters provided on each of the cathodes and capable of performing electron emission with a voltage applied only between the cathodes and the anode, the display device being constructed to perform display by bringing pixels to dark states by applying a cut-off voltage between the cathodes and the gates to cut off electron emission from the electron emitters toward the anode; and a control unit for controlling the operation of a display panel driving circuit in order to complete, when a display completing signal is generated, application of the cut-off voltage or a driving voltage (drive voltage) capable of providing a particular display state, after a predetermined time passes from the moment when a potential of the anode decreases below a threshold potential capable of causing electron emission from the electron emitters with the cut-off voltage or the driving voltage capable of providing the particular display state being applied between the cathodes and the gates.

According to this display device, it is possible to restrain the occurrence of an unsatisfactory display state and unsatisfactory luminescence in the case where the anode potential is made to transition from a supply state to a cut-off state in response to the occurrence of a display completing signal.

Another object of the invention is to provide a driving and controlling method for a display device which includes: a display panel having cathodes, gates and an anode, the cathodes and the gates being connected in matrix form; electron emitters provided on each of the cathodes and capable of performing electron emission with a voltage applied only between the cathodes and the anode, the display device being constructed to perform display by bringing pixels to dark states by applying a cut-off voltage between the cathodes and the gates to cut off electron emission from the electron emitters toward the anode, the driving and controlling method including: an anode potential supply stopping step of decreasing, when a display completing signal is generated, a potential of the anode to a potential below a threshold potential capable of causing electron emission from the electron emitters with the cut-off voltage or the driving voltage capable of providing a particular display state being applied between the cathodes and the gates; and an application stopping step of stopping the application of the cut-off voltage or the driving voltage capable of providing the particular display state, after a predetermined time passes from the moment when the anode potential supply stopping step is performed.

DETAILED DESCRIPTION OF THE PREFERRED EMBODIMENTS

Preferred embodiments of the invention will be illustratively described below in detail with reference to the accompanying drawings. In the following description, unless otherwise specified, the scope of the invention is not to be construed to be limited to specific factors such as dimensions, materials, shapes or arrangements of individual constituent components of embodiments which will be described below.

(First Embodiment)

Figure 1:
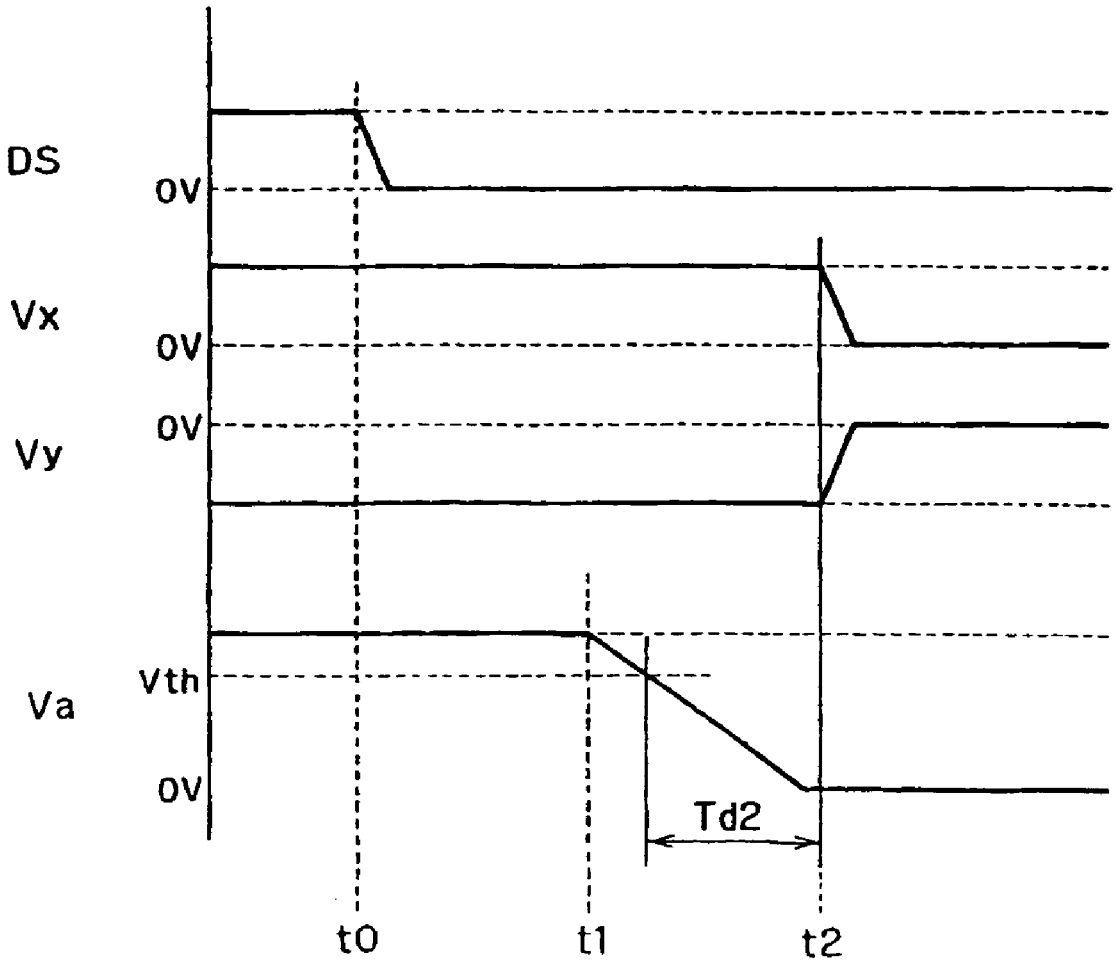
FIG. 1 is a timing chart aiding in explaining a driving and controlling method for a display device according to a first embodiment of the invention.
Figure 2:
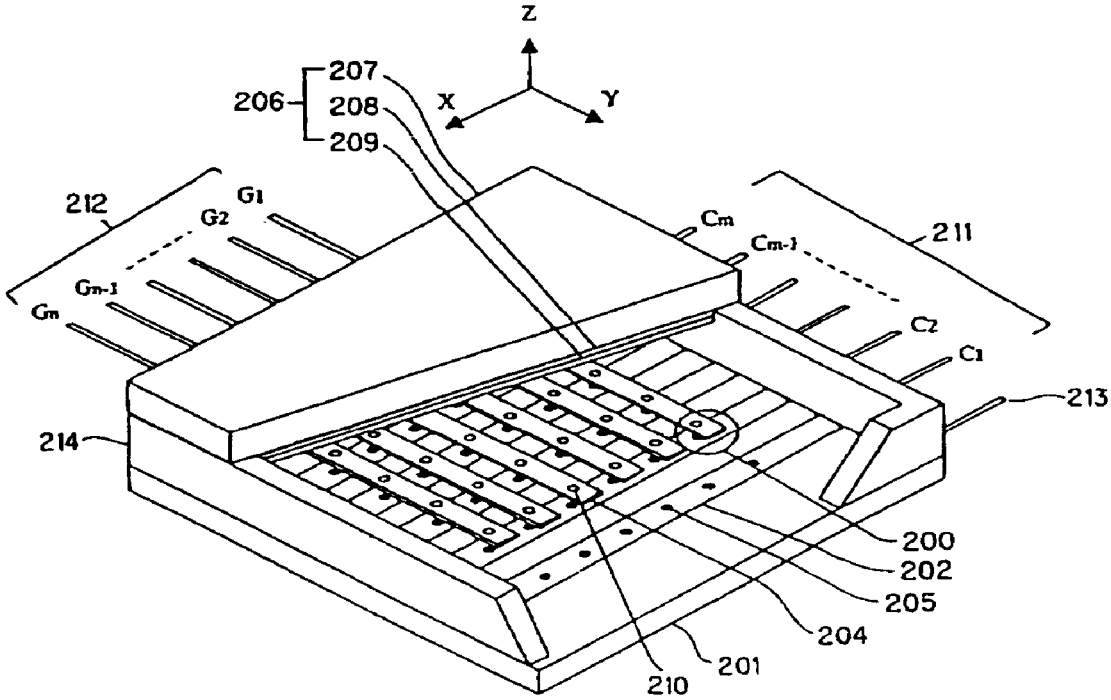
FIG. 2 is a partly broken away, diagrammatic view of a display panel for use in the first embodiment of the invention.
Figure 3:
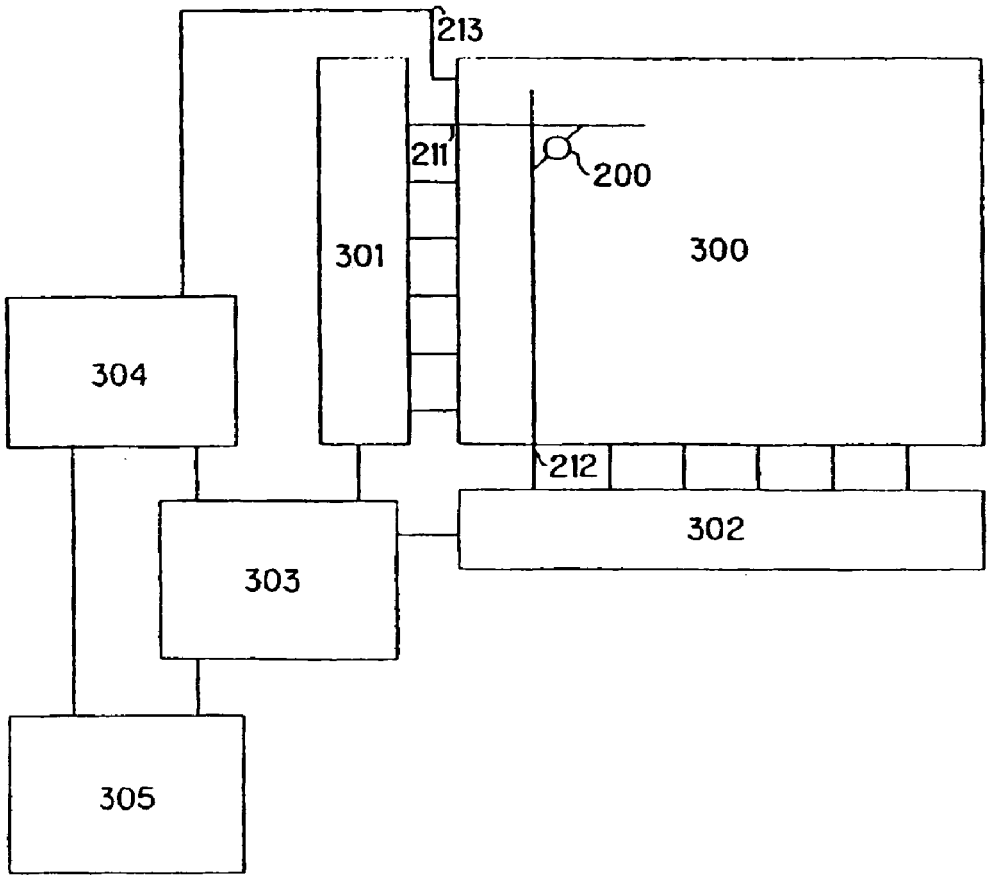
FIG. 3 is a block diagram of a driving and controlling system for the display device according to the first embodiment of the invention.

FIG. 1 is a timing chart aiding in explaining a driving and controlling method for a display device according to a first embodiment of the invention. FIG. 2 shows the construction of a display panel for use in the first embodiment of the invention. FIG. 3 is a block diagram showing a driving and controlling system for the display device according to the first embodiment of the invention.

The display device which is a flat-panel display related to the first embodiment is obtained by arranging a plurality of matrix-connected electron emission elements into columns and rows.

The display panel shown in FIG. 2 includes an electron source substrate 201, a faceplate 206, an external frame 214, row lines 211, column lines 212, and normally-on type electron emission elements 200.

A phosphor layer 208 provided as an image forming member is disposed in opposition to the simple matrix electron source substrate 201 in the state of being positioned on the faceplate 206 that correspond to the tops of the respective electron emission elements 200.

An aluminum-based wiring material which serves as a conductor for high voltage application is provided on the phosphor layer 208 as a metal back 209 by evaporation or the like. A high-voltage terminal 213 for supplying a high potential is electrically connected to the metal back 209.

An anode substrate 207 is provided on the surface of the phosphor layer 208 opposite to the side on which the metal back 209 is provided.

As shown in FIG. 2, the row lines 211 include m-number of row lines C1, C2 . . . Cm, and are arranged in stripes. Each of the row lines 211 forms a cathode 202. The row lines 211 are made of an electrically conductive material, such as aluminum or silver, formed by an evaporation method or the like. Incidentally, the material, the film thickness and the line width of each of the row lines 211 can be suitably designed, and a manufacturing method for the row lines 211 can also be suitably selected.

Electron emitters 205 are respectively formed at the positions of the electron emission elements 200 on each of the cathodes 202 arranged in stripes. Incidentally, as described previously, the electron emitters 205 may use a fibrous nanostructure made of a carbon-based or non-carbon-based semiconductor or conductor which is low in electron emission threshold.

The column lines 212 include n-number of column lines G1, G2 . . . Gm, and are arranged in stripes perpendicular to the row lines 211. Each of the column lines 211 forms a gate 204. The column lines 212 are constructed similarly to the row lines 211.

Each of the gates 204 arranged in stripes has hole portions 210 each opened in one of portions which correspond to the respective tops of the electron emitters 205 of the cathodes 202.

Incidentally, for the sake of simplicity of illustration, the illustration of the hole portions 210 as well as the gates 204 which are arranged in stripes is omitted in a portion above the cathode 202 (C1) which is located on the nearest side as viewed in FIG. 2.

Although the respective cathodes 202 are provided along the row lines 211 with the respective gates 204 provided along the column lines 212, this connection arrangement may be reversed.

An interlayer insulating layer, which is not shown for the sake of simplicity of illustration, is provided between these m-number of row lines 211 and n-number of column lines 212 to electrically separate both lines 211 and 212 (in the above description, m and n are positive integers). It is to be noted that the interlayer insulating layer is not provided in any of portions that correspond to the electron emitters 205 and the hole portions 210.

The interlayer insulating layer which is not shown is an insulating layer formed by using a sputtering method or the like. For example, the interlayer insulating layer is formed in the desired shape on part or the whole of the surface of the electron source substrate 201 where the row lines 211 are formed. It is preferable to suitably select, particularly, the film thickness, the material and the process preparation of the interlayer insulating layer so that the interlayer insulating layer can withstand the potential differences at the intersections of the row lines 211 and the column lines 212.

The row lines 211 and the column lines 212 are led to external terminals, respectively.

In the first embodiment, layers each including pairs of electrodes constituting the respective electron emission elements 200 also serve the functions of the m-number of row lines 211 and the n-number of column lines 212. However, it is also preferable that the cathode 202 and the gate 204 both of which are independent of the column and row lines be provided for each electron emission element and gate electrodes and gate lines as well as cathode electrodes and cathode lines be separately formed so that a plurality of independent gates 204 arranged along each of the column lines in the Y-direction are connected in common by the corresponding column line and a plurality of independent cathodes 202 arranged along each of the row lines in the X-direction are connected in common by the corresponding row line.

As shown in FIG. 3, a scanning signal applying unit 301 which applies a scanning selecting signal for selecting a particular row along which the electron emission elements 200 are arranged in the X-direction is connected to the row lines 211.

In addition, a modulated signal applying unit 302 for performing modulation on each column of electron emission elements 200 arranged in the Y-direction is connected to the column lines 212.

The cut-off voltage between each of the cathodes 202 and any one of the gates 204 that is to be applied to the corresponding one of the electron emission elements 200 is supplied as a difference voltage between a scanning signal and a modulated signal which are to be applied to the corresponding electron emission element 200. It is to be noted that the first embodiment is constructed so that the respective row lines 211 are made the cathodes 202 to apply zero potential or a positive potential to each of the cathodes 202, while the respective column lines 212 are made the gates 204 to supply zero potential or a positive negative potential to each of the gates 204 as a modulated signal.

The driving of the electron emission elements 200 each of which constitutes a pixel is performed in the following manner.

A high potential is supplied to the metal back 209 (hereinafter referred to as the anode) to hold its anode potential at a value sufficient to cause electrons to be emitted from the electron emitters 205 in dependence on the cathode-gate voltage.

During this state, a positive potential is supplied as a scanning non-selecting potential to the cathode 202 of the one of the row lines 211 which corresponds to a non-selected scanning line. In addition, zero potential is supplied as a scanning selecting potential to the cathode 202 of the one of the row lines 211 which corresponds to a selected scanning line. At the same time, zero potential or a negative potential is given as a modulated signal to each of the gates 204 of the column lines 212.

In the non-selected scanning line, since the cathode-anode voltage is set to a value which does not cause electron emission from the electron emitters 205 irrespective of the potential (zero potential or negative potential) of the modulated signal, electrons are not emitted from the electron emitters 205 lying on the non-selected scanning line, so that the pixels in that row do not emit light.

On the other hand, in each of the electron emission elements 200 to which the modulated signal of zero potential is given in the selected scanning line, its cathode-gate voltage becomes zero and its cathode-anode voltage exceeds the threshold voltage of electron emission, so that electrons are emitted from each of the electron emission elements 200 and the corresponding pixels emit light. In the invention, even if the electron emission elements 200 are of the normally-on type, the voltage which is applied between the cathodes and the gates for electron emission may be any voltage other than voltages which preclude electron emission due to the anode voltage, and need not be limited to 0 V. Namely, the applied voltage may also be set to a bias condition which causes the potential at the gate to be slightly positive with respect to the potential at the cathode.

In addition, in each of the electron emission elements 200 to which the modulated signal of negative potential is given in the selected scanning line, its cathode-gate voltage becomes the cut-off voltage and its cathode-anode voltage exceeds the threshold voltage of electron emission, but an actual electric field strength at each of the electron emitters 205 does not exceed the threshold of electron emission, owing to the influence of the gate potential, so that electrons are not emitted from the corresponding electron emission elements 200 and the corresponding pixels do not emit light.

By performing such scanning while sequentially selecting at least one line, one picture scanning cycle is completed, whereby an image corresponding to input display image data is displayed.

A display completing sequence will be described below with reference to FIGS. 1 and 3.

As shown in FIG. 3, the scanning signal applying unit 301 and the modulated signal applying unit 302 are respectively supplied with the signals required to generate a scanning signal and a modulated signal, from a control circuit 303 which serves as a control unit. In addition, a control signal for controlling the operation of an anode power source circuit 304 is supplied from the control circuit 303.

A body power source 305 is provided on the upstream side of power supply circuitry in order to supply the voltages required for the respective operations of the control circuit 303 and the anode power source circuit 304.

For the sake of simplicity of description, a detailed description is not given herein in connection with any other signal processing circuit necessary for image display as well as the constructions of the scanning signal applying unit 301 and the modulated signal applying unit 302.

As shown in FIG. 1, when a power source switch on the upstream side is turned off to turn off the power source, the supply of power from the body power source 305 is cut off, whereby a low-level display signal DS is generated in the control circuit 303 at time t0 (in FIG. 1, H→L). Otherwise, the display signal DS may also be supplied to the control circuit 303 from the body power source 305 itself.

When the predetermined time required to stop the anode power source circuit 304 passes after the display signal DS has been generated, the control circuit 303 stops the supply of an anode potential Va from the anode power source circuit 304 to the high-voltage terminal 213. After the supply has been stopped, the anode potential Va decreases not sharply but gradually, because electric charge is accumulated on the anode.

Until the anode potential Va reaches 0 V after the display signal DS has been generated, if the anode potential Va is in excess of a potential Vth at which an electric field strength not lower than the threshold electric field of the electron emitter 205 of the electron emission element 200 can be obtained, the electron emitter 205 continues to emit electrons. Therefore, in order that the cut-off voltage be supplied between the cathode and the gate even after time t1, the potential of at least one of the row line 211 and the column line 212 is held at a potential which enables the cut-off voltage to be applied to the electron emission element 200.

Specifically, in the first embodiment, even after the time t1, a positive potential continues to be applied as a scanning non-selecting signal Vx, while a negative potential continues to be applied as a modulated signal Vy. Namely, even after the time t1, the control circuit 303 continues to perform the supply of the positive potential from the scanning signal applying unit 301 to the cathode 202, and at the same time, continues to perform the supply of the negative potential from the modulated signal applying unit 302 to the gate 204.

Then, after a predetermined delay time Td2 has passed from the time point when the anode potential Va decreases below the potential Vth at which the electric field strength not lower than the threshold electric field of the electron emitter 205 can be obtained, the control circuit 303 stops the application of the cut-off voltage at time t2.

If the potential of the cathode 202 or the gate 204 is indefinite immediately after the application of the cut-off voltage has been stopped, the cathode 202 or the gate 204 may be electrically charged. Therefore, as occasion demands, it is desirable to hold the cathode 202 and the gate 204 at the same potential for a predetermined time. Generally, Vx=Vy=0 is preferable.

As described previously, in the first embodiment, since the cathodes 202 are used as the row lines 211 and the gates 204 are used as the column lines 212, all the modulated signals for the column lines 212 may be controlled to become the negative potential that can generate the cut-off voltage. Namely, data which provide full-screen black display may be controlled to be given as display image data from the control circuit 303 to the modulated signal applying unit 302. In this case, the scanning signal may be the scanning selecting potential (zero potential) or a potential higher than the same.

Otherwise, all the scanning signals for the row lines 211 may be controlled to become the positive potential that can generate the cut-off voltage. In this case, since the modulated signals may be zero potential or a potential lower than the zero potential, the modulated signals may be either black display data (negative potential) or white display data (zero potential).

The sequence of FIG. 1 shows an example in which the scanning signals for all the row lines 211 are controlled to become the positive potential, while the modulated signals for all the column lines 212 are controlled to become the negative potential, whereby the cut-off voltage to be applied between the cathodes and the gates is increased to positively restrain electron emission. However, as described above, the potential of either one of the cathode 202 and the gate 204 may be made the potential which can generate the cut-off voltage.

The transition timing of each of the potentials can be realized by the control of the control circuit 303.

Incidentally, when account is taken into the variations of the fall times of the respective supply potentials Vx, Vy, Va and the like due to the nonuniformity or the like of constituent components, the variations of threshold electric fields among a plurality of electron emission elements, or the case where the voltage-current characteristics of such electron emission elements have hysteresis, it is desirable that the time Td2 at which Vx and Vy reach the respective predetermined potentials after Va decreases below the potential Vth which generates the threshold electric field of the electron emitter 205 be set to approximately 13 ms or more or to 26 ms or more.

According to this sequence, it is possible to prevent the phenomenon that the whole screen emits light in full-screen white at the maximum luminance when the low-level display signal DS is generated during a power-off state or a display stop state Incidentally, it is also possible to determine the transition timing so that the application of the predetermined cathode-gate cut-off voltage is stopped before the anode potential Va decreases to 0 V, and the application of the cathode-gate cut-off voltage is stopped immediately after the anode potential Va decreases below the threshold potential Vth. However, it cannot be said that there is no possibility that the electric field strength between the cathode 202 and the anode exceeds the threshold electric field and causes electron emission, owing to a transient capacitive voltage remaining after the stop of the supply of the anode potential Va. Accordingly, it is more desirable to stop the application of the cut-off voltage between the cathode 202 and the gate 204 after the anode potential Va is decreased to 0 V.

(Second Embodiment)

Figure 4:
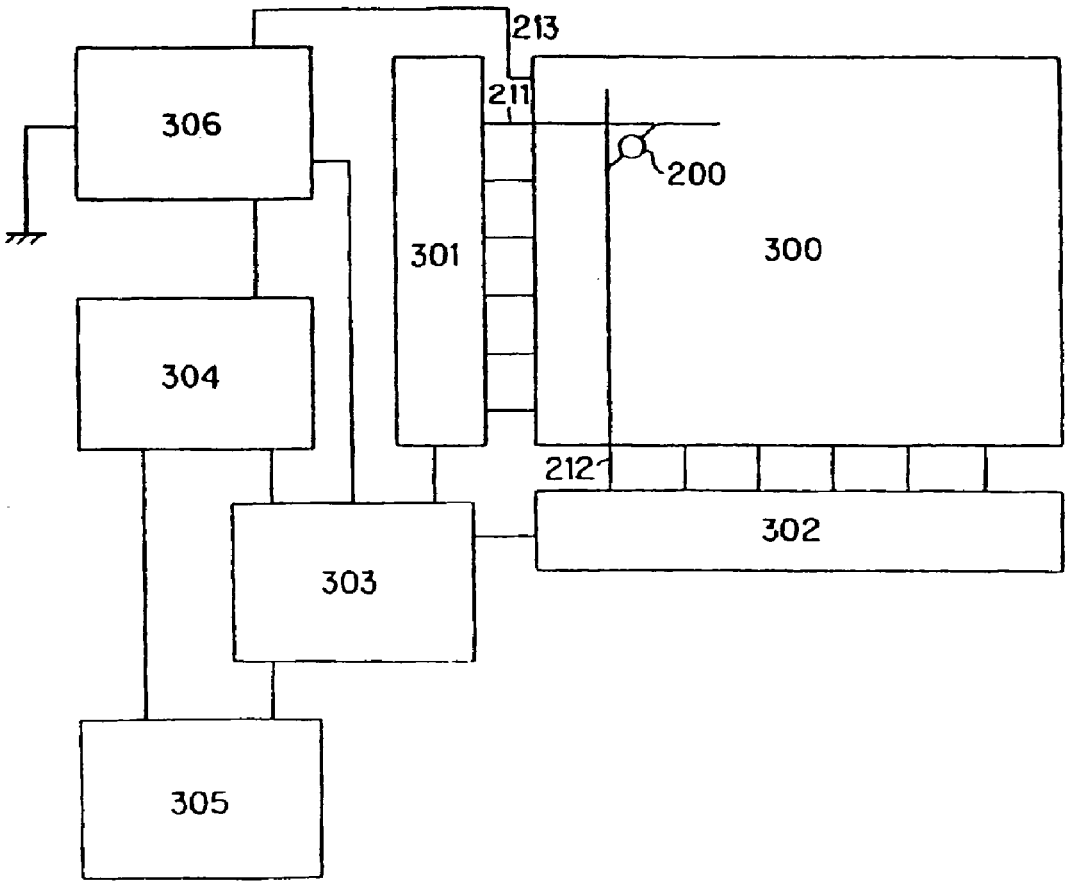
FIG. 4 is a block diagram of a driving and controlling system for a display device according to a second embodiment of the invention.

FIG. 4 shows a second embodiment. In the second embodiment, a cut-off grounding circuit 306 is added to the control system of the display device according to the first embodiment.

In the first embodiment, even after the supply of the anode potential Va is stopped, the anode potential Va tends not to immediately decrease to 0 V, because electric charge is accumulated on the anode. In the case of a large-sized flat-panel display device or the like in particular, its display area, namely, its anode area, is large and the amount of accumulation of electric charge is large, so that the anode potential Va more greatly tends not to decrease to 0 V after the stop of the supply of the anode potential Va.

Accordingly, in the second embodiment, when the display completing sequence is to be executed as rapidly as possible, as in the case where a power source voltage is cut off by a power failure or the like, the cut-off grounding circuit 306 is connected to an intermediate point between the anode power source circuit 304 and the high-voltage terminal 213 of a display panel 300, as shown in FIG. 4, in order to reduce the time until which the anode potential Va decreases below the threshold potential Vth.

Accordingly, as the control circuit 303 generates the display signal DS as a low-level signal, the cut-off grounding circuit 306 cuts off and stops the high-potential supply from the anode power source circuit 304, and then, grounds the high-voltage terminal 213 to cause the anode to discharge the accumulated electric charge to GND, thereby reducing the anode potential Va to the potential Vth or lower as rapidly as possible.

Incidentally, the cut-off of the supply of the anode potential Va may also be performed by turning off the output of the anode power source circuit 304. In this case, after the output of the anode power source circuit 304 has been turned off by the control circuit 303, the high-voltage terminal 213 may be grounded by the cut-off grounding circuit 306.

(Third Embodiment)

FIGS. 5 to 11 show a third embodiment. In the following description of the third embodiment, the construction of the invention using various circuits will be described in greater detail than in the above description of the first embodiment.

Figure 5:
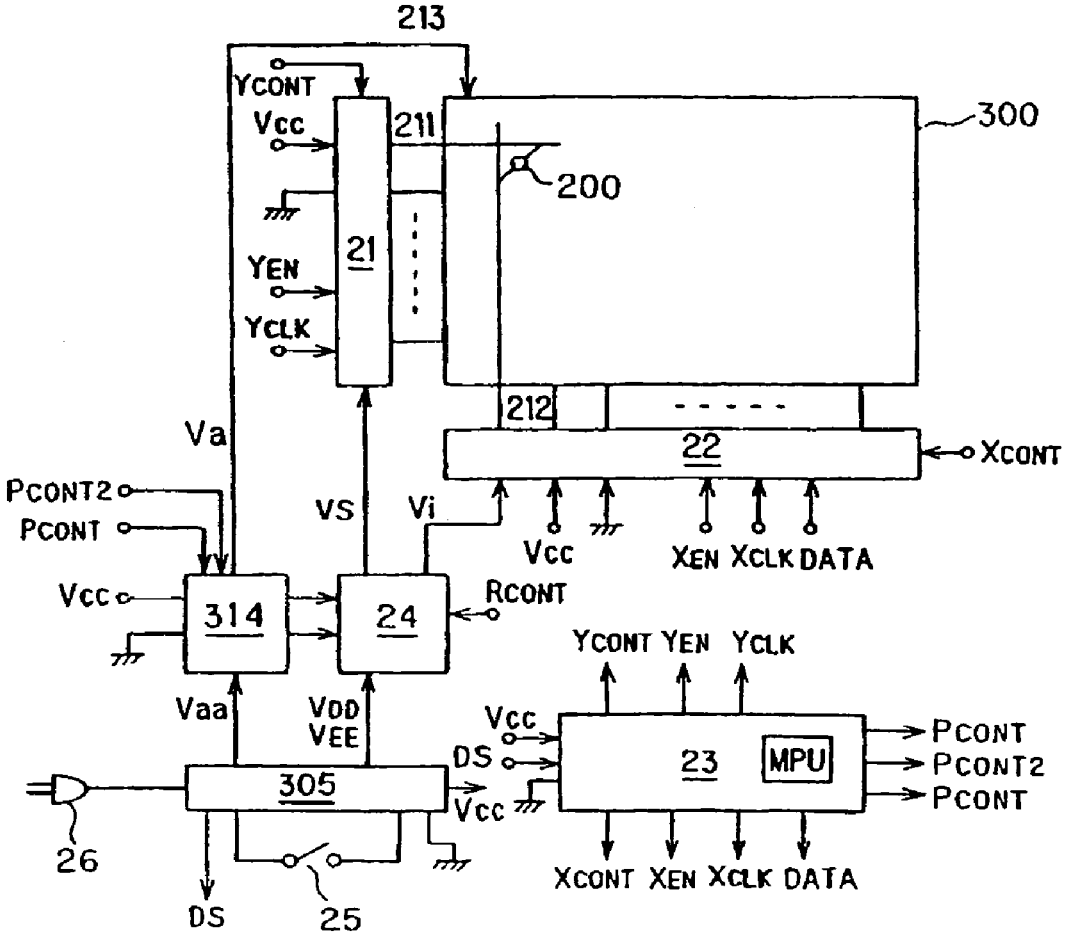
FIG. 5 is a block diagram of a driving and controlling system for a display device according to a third embodiment of the invention.

FIG. 5 is a block diagram showing a driving and controlling system for a display device according to the third embodiment of the invention.

Figure 6:
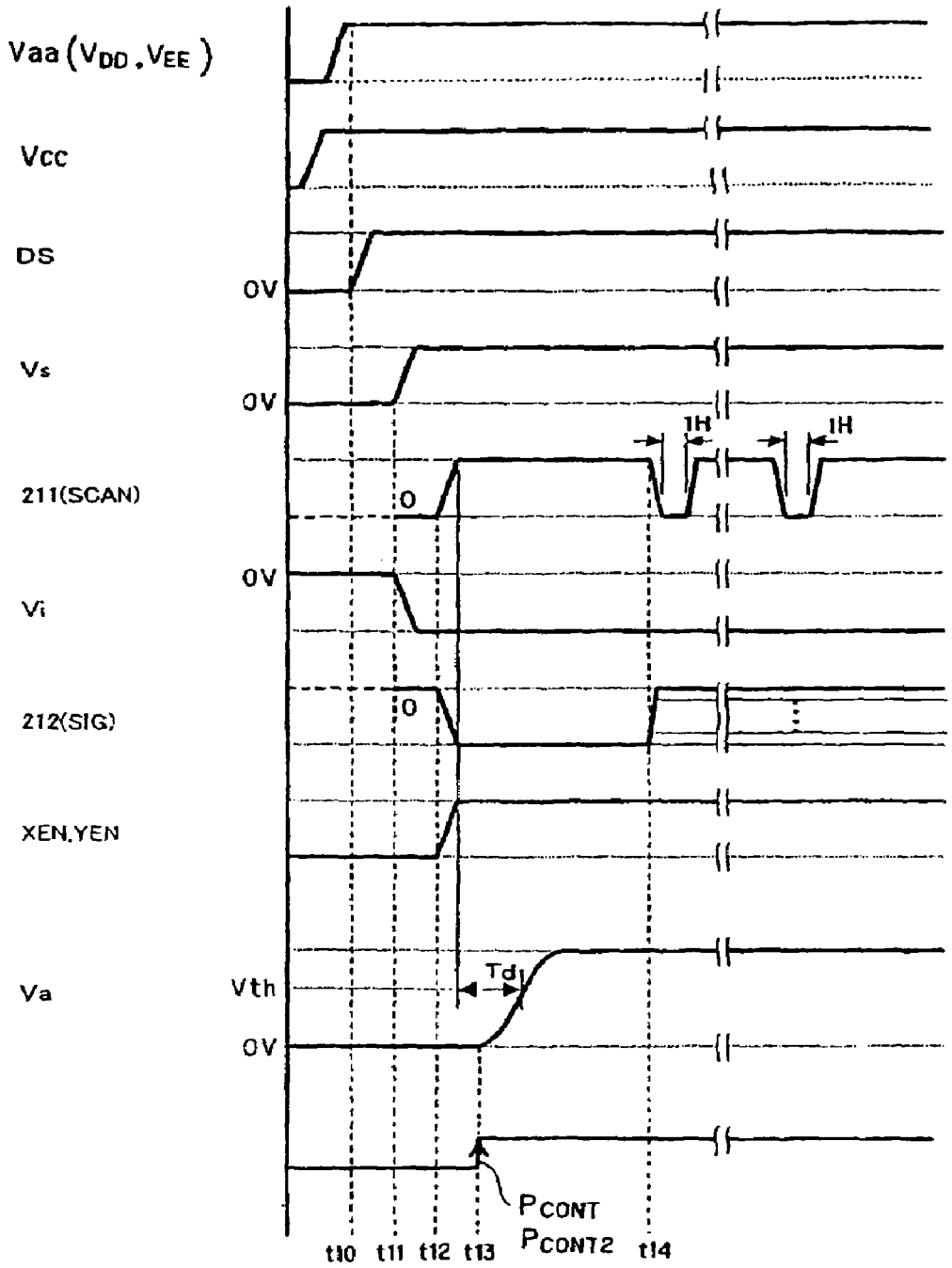
FIG. 6 is a timing chart showing a driving and controlling method for the display device according to the third embodiment of the invention.
Figure 7:
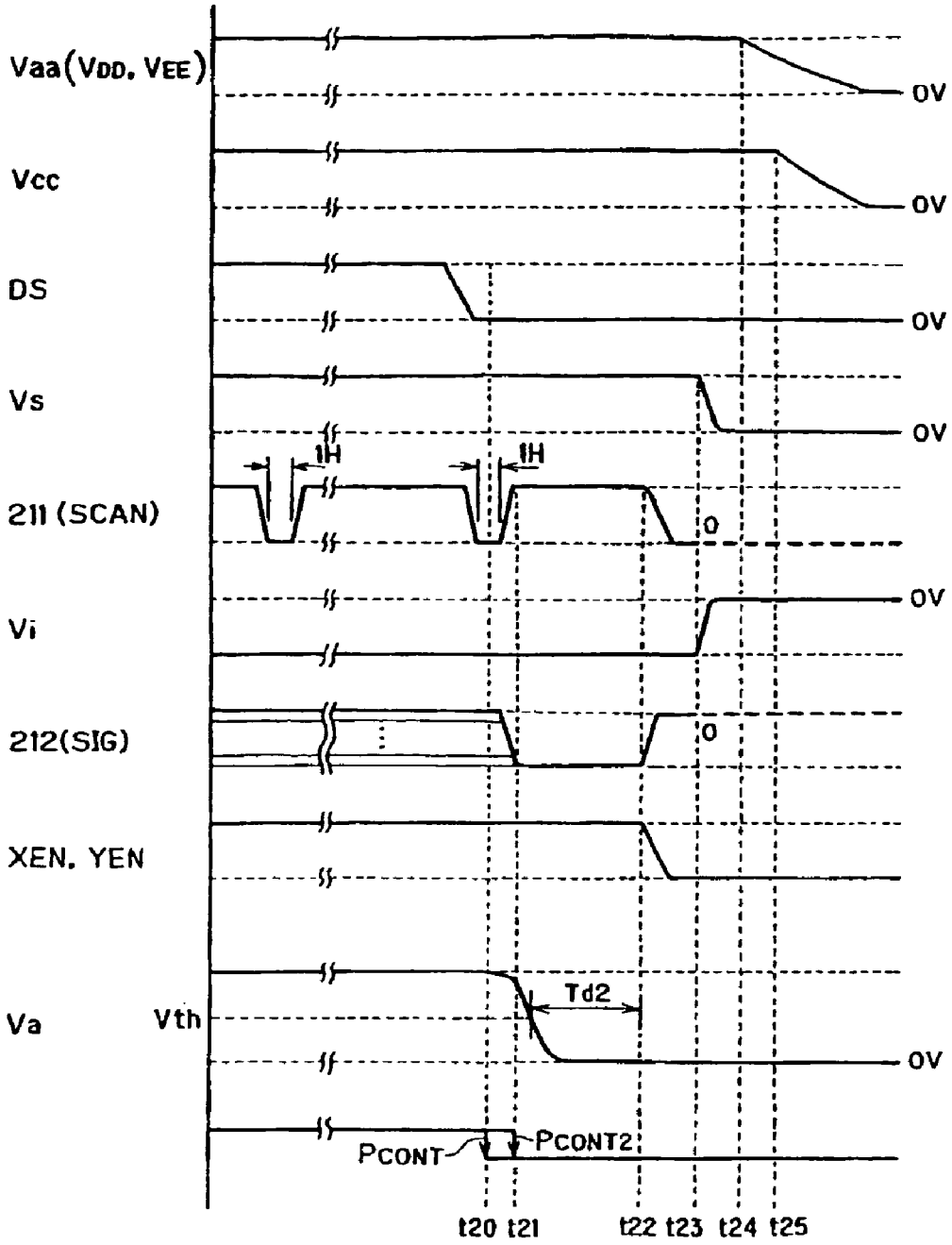
FIG. 7 is a timing chart showing a driving and controlling method for the display device according to the third embodiment of the invention.

FIGS. 6 and 7 show timing charts aiding in describing a driving and controlling method for the display device according to the third embodiment of the invention.

The display panel 300 has cathodes, gates and an anode, and the cathodes and the gates are matrix-connected. Although FIG. 5 shows only one electron emission element 200, a multiplicity of elements are arranged in matrix form in practice. Since an example of the display panel 300 is previously described in connection with the first embodiment, the detailed description of the display panel 300 is omitted hereinafter.

In this display panel 300, each of the cathodes is provided with electron emitters capable of performing electron emission with a voltage applied only between the cathodes and the anode, and the cut-off voltage is applied between the cathodes and the gates to cut off electron emission from the electron emitters toward the anode, thereby bringing individual pixels to dark states, respectively, whereas a driving voltage is applied between the cathodes and the gates to cause electron emission from the electron emitters toward the anode, thereby bringing individual pixel to bright states, respectively. In this manner, the display panel 300 performs image display.

A display panel driving circuit for driving the display panel 300 has an anode power source circuit 314 for supplying an anode potential Va to the anode, a cathode driving circuit 21 for driving the cathodes, a gate driving circuit 22 for driving the gates, and a driving power source circuit 24 which supplies driving reference potentials Vs and Vi for generating a cut-off voltage and a driving voltage capable of providing a particular display state to the cathode driving circuit 21 and the gate driving circuit 22, respectively.

The driving reference potential Vi preferably includes, for example, three or more driving reference potentials for the purpose of voltage amplitude modulation (PHM) driving for gray scale display.

Figure 8:
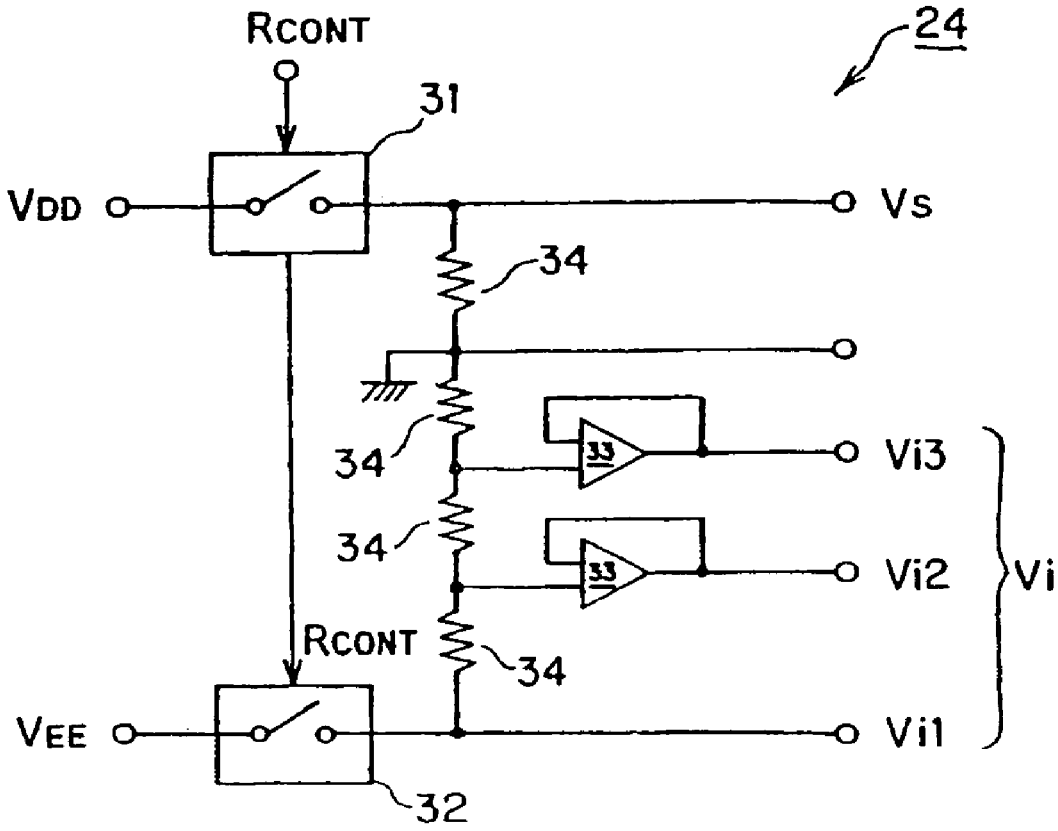
FIG. 8 is a circuit diagram showing one example of a driving power source circuit used in the third embodiment of the invention.
Figure 9:
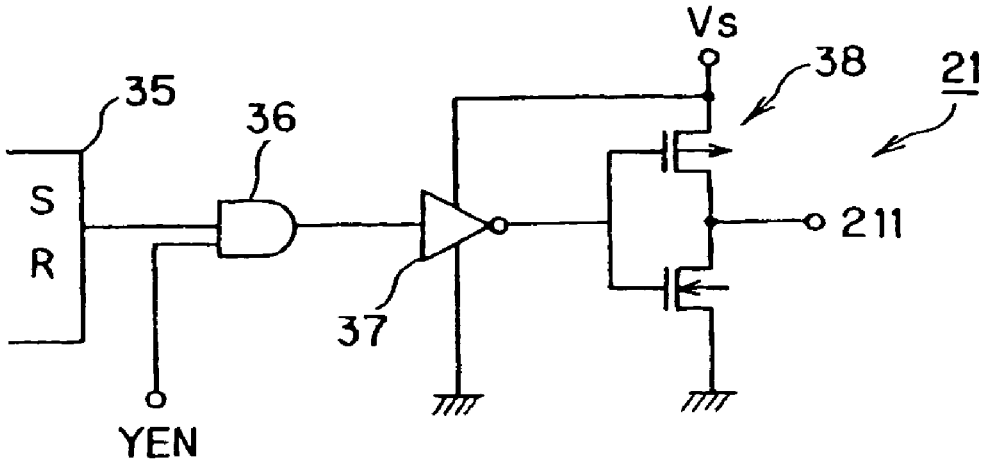
FIG. 9 is a circuit diagram showing one example of a row driving circuit used in the third embodiment of the invention.
Figure 10:
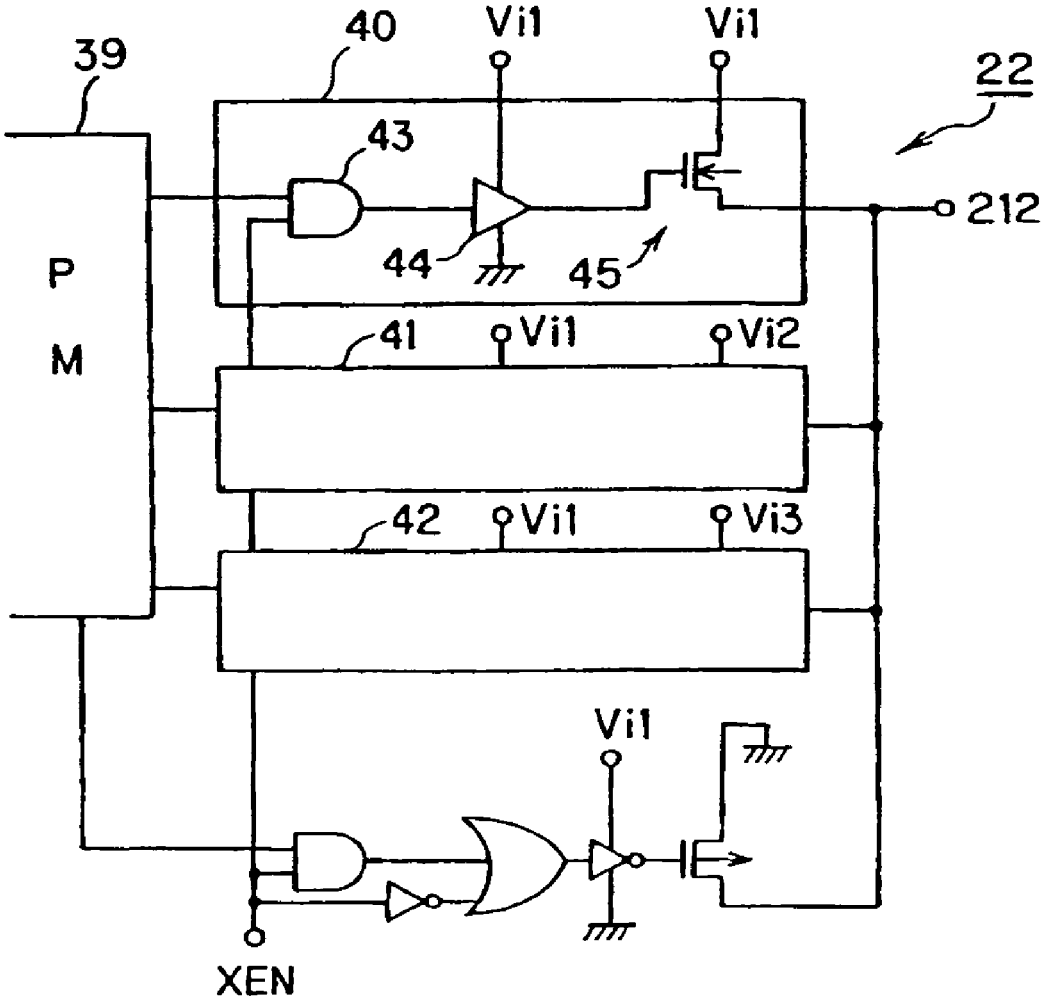
FIG. 10 is a circuit diagram showing one example of a row driving circuit used in the third embodiment of the invention.
Figure 11:
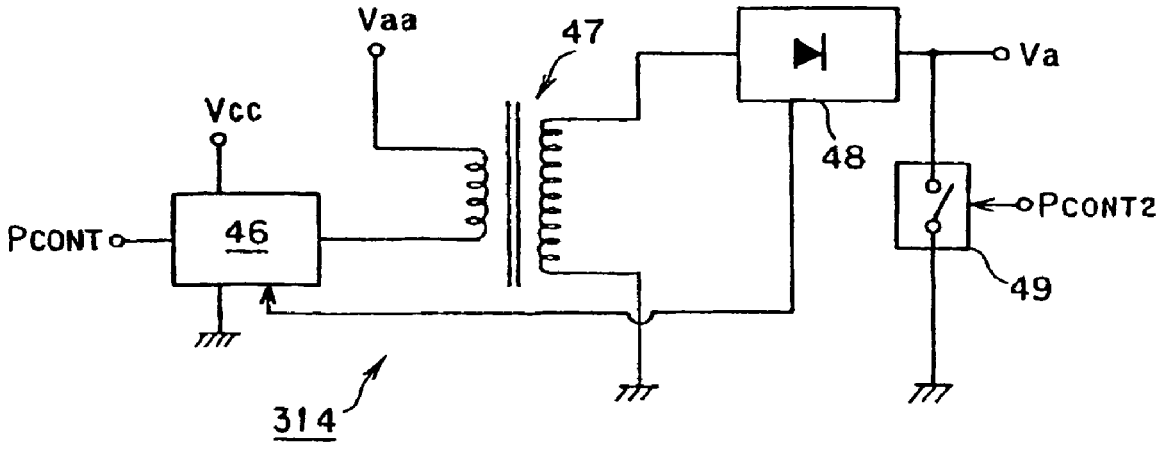
FIG. 11 is a circuit diagram showing one example of an anode power source circuit used in the third embodiment of the invention.

FIG. 8 is a circuit diagram of the driving power source circuit 24. FIG. 9 is a circuit diagram of a row driving circuit (in FIG. 5, the cathode driving circuit 21). FIG. 10 is a circuit diagram of a column driving circuit (in FIG. 5, the gate driving circuit 22). FIG. 11 is a circuit diagram of the anode power source circuit 314. Any of these circuits is provided with a certain type of logic circuit which uses a logic circuit driving potential Vcc of 5 V or 3.3 V as its operating power source.

The driving power source circuit 24 shown in FIG. 8 has switches 31 and 32 for respectively turning on/off the supply of power from the body power source 305, namely, the supply of potentials VDD and VEE such as +50 V and −50 V, in response to a control signal RCONT, operational amplifiers 33 which serve as voltage followers, and a plurality of resistors 34. The driving power source circuit 24 is a multiple power source which supplies three negative potentials (Vi1, Vi2 and Vi3) to the column driving circuit and a scanning selecting potential Vs to the row driving circuit.

The row driving circuit (the cathode driving circuit 21) shown in FIG. 9 has a vertical shift resist SR 35 which shifts its output level row by row in synchronism with a clock YCLK, an AND gate 36 for controlling the supply of the scanning selecting potential Vs in response to an enable signal YEN, a level shifting circuit 37 for stepping up its output voltage from a low voltage (Vcc–0 V) for a logic circuit to a driving high voltage (Vs–0 V), and an output-stage high-voltage CMOS inverter 38 for outputting a scanning signal which provides a scanning selecting potential or a scanning non-selecting potential. In FIG. 9, there is shown only a row driving circuit for one channel.

The column driving circuit (the gate driving circuit 22) shown in FIG. 10 has a pulse modulator PM 39 for modulating digital display image data inputted from a driving control circuit 23, and three selecting circuits 40, 41 and 42 for selectively outputting three modulated potentials Vi1, Vi2 and Vi3. Each of the selecting circuits 40, 41 and 42 has an AND gate 43 for controlling the supply of the respective one of the modulated potentials in response to an enable signal XEN, a level shifting circuit 44, and an output-stage high-voltage CMOS inverter 45. In FIG. 10, there is shown only a column driving circuit for only one channel.

The anode power source circuit 314 shown in FIG. 11 has a feedback control type of transformer control circuit 46 which controls the operation of a high voltage output transformer 47 in response to a control signal PCONT, a rectifier circuit 48 which rectifies an alternating current converted into a high voltage, a switch 49 which turns on/off in response to a control signal PCONT2, for grounding the anode potential Va to GND. The anode power source circuit 314, in response to the control signal PCONT, converts a potential Vaa supplied from the body power source 305 into the anode potential Va which is a high voltage to be supplied to the anode, and outputs the anode potential Va. Incidentally, the body power source 305 and the anode power source circuit 314 may also be constructed as one circuit block.

Returning to FIG. 5, the sequence of a power-on operation will be described below. When a power source plug 26 is connected to a commercial power source and a body power source switch 25 disposed on the upstream side of power supply circuitry is turned on, the body power source 305 supplies the logic circuit driving potential Vcc to the logic circuit contained in each of the circuits 21 to 24 and 314. At the same time as or slightly later than the moment when the on state of the body power source switch 25 is detected, at the time t10 shown in FIG. 6, a display signal DS generates a high-level start signal which indicates the start of display. In addition, when the body power source switch 25 is turned on, the body power source 305 supplies an operating voltage which becomes a source for generating the anode potential Va as well as the driving reference potentials Vs and Vi, to the anode power source circuit 314 and the driving power source circuit 24.

The driving control circuit 23 is generally a control unit having a central operation processing part such as an MPU. The driving control circuit 23 supplies the control signals PCONT and PCONT2 to the anode power source circuit 314, the control signal RCONT to the driving power source circuit 24, a clock YCLK for vertical scanning, the enable signal YEN and a control signal YCONT to the cathode driving circuit 21, and a clock XCLK for horizontal scanning, the enable signal XEN, a control signal XCONT and display image data DATA to the gate driving circuit 22.

When the control signal PCONT2 is off (low level), the switch 49 is closed and the anode power source circuit 314 holds the anode potential at a particular potential such as zero potential sufficiently lower than the threshold potential Vth capable of causing electron emission from the electron emitters.

The driving power source circuit 24 normally outputs zero potential, and when the input control signal RCONT is turned on at the time t11 shown in FIG. 6 with the logic circuit driving potential Vcc supplied to the driving power source circuit 24, the driving power source circuit 24 starts to supply the respective driving reference potentials Vs and Vi to the cathode driving circuit 21 and the gate driving circuit 22. At this time, the output of each of the cathode driving circuit 21 and the gate driving circuit 22 transitions from a high-impedance indefinite potential state to zero potential, so that the potentials between the cathodes and the gates are held at the same potential.

At time t12, when each of the enable signals XEN and YEN goes to a high level, the cathode driving circuit 21 starts to supply high-voltage non-selecting potentials to all the cathodes (the row lines 211), and nearly at the same time, the gate driving circuit 22 starts to supply low-voltage non-selecting potentials to all the gates (the column lines 212). In this manner, the cut-off voltage is applied between the cathode and the gate of each of the electron emission elements 200.

At time t13 later than the time t12, each of the input control signals PCONT and PCONT2 is turned on (high level), and the anode power source circuit 314 starts to supply the high-voltage anode potential Va to the anode.

At time t14 following the time when the anode potential Va reaches a predetermined level on the basis of the time constant of the output side of the anode power source circuit 314, the application of image-displaying driving voltages to the electron emission elements 200 at individual matrix intersections is enabled by the control signals XCONT and YCONT. Namely, the cathode driving circuit 21 starts scanning, while the gate driving circuit 22 starts to supply modulated potentials based on the display image data DATA to the display panel 300.

In this manner, during one horizontal scanning period (1H), at least one of the row lines 211 is selected and zero potential is supplied thereto, and the modulated potentials based on the display image data DATA are supplied to a multiplicity of column lines 212 in synchronism with the supply of this zero potential. One frame of image display is performed by line sequential driving which performs such scanning sequentially in the vertical direction. At this time, the cut-off voltage is applied between the cathode and the gate of each pixel in the non-selected scanning lines and between the cathode and the gate of each pixel in the selected scanning lines to which a modulated potential for black display data is given, whereby the corresponding pixels are brought to dark states, respectively.

The sequence of a power-off operation will be described below with reference to FIG. 7. In the body power source 305, the body power source switch 25 disposed on the upstream side of power supply circuitry is turned off by a user. At the same time as or slightly later than the moment when the off state of the body power source switch 25 is detected, the display signal DS generates a low-level end signal which indicates the end of display. In addition, when the body power source switch 25 is turned off, at the time t20 shown in FIG. 7, the control signal PCONT to be inputted to the anode power source circuit 314 is turned off, and control is performed to stop supplying the operating voltage which becomes a source for generating the anode potential Va to the anode power source circuit 314.

Therefore, the anode potential Va starts to decrease at the time t20, but since electric charge is accumulated on the anode, the anode potential Va decreases not sharply but gradually.

Then, at time t21 which is later than the time t20 by a slight time period, the control signal PCONT2 which is being supplied from the driving control circuit 23 to the anode power source circuit 314 is turned off, and the switch 49 of the anode power source circuit 314 is turned on in response to the control signal PCONT2, whereby the anode potential Va is grounded to GND. Accordingly, at the time t21, the anode potential Va sharply decreases toward 0 V.

Until this time t21, the application of the image-displaying driving voltages to the electron emission elements 200 at individual matrix intersections by the control signals XCONT and YCONT is completed. Namely, the cathode driving circuit 21 completes scanning, while the gate driving circuit 22 stops supplying the modulated potentials based on the display image data DATA to the display panel 300.

However, even after the time t21, each of the enable signals XEN and YEN is held at the high level, and the cathode driving circuit 21 starts to supply high-voltage non-selecting potentials to all the cathodes (the row lines 211), and at the same time, the gate driving circuit 22 starts to supply low-voltage non-selecting potentials to all the gates (the column lines 212). Accordingly, the cut-off voltage continues to be applied between the cathode and the gate of each of the electron emission elements 200.

This cut-off voltage serves to prevent electron emission from occurring when the anode potential Va is in excess of the potential Vth at which an electric field strength not lower than the threshold electric field of the electron emitter 205 of the electron emission element 200 can be obtained.

Then, at time t22 until which a predetermined delay time Td2 passes after the time when the anode potential Va decreases below the threshold potential Vth capable of causing electron emission from the electron emitters, that is to say, until which a sufficient length of time passes after the anode potential Va decreases to 0 V, each of the enable signals XEN and YEN is reset to a low level, and the cathode driving circuit 21 stops supplying the high-voltage non-selecting potentials to all the cathodes (the row lines 211), and at the same time, the gate driving circuit 22 stops supplying the low-voltage non-selecting potentials to all the gates (the column lines 212). In this manner, the application of the cut-off voltage between the cathode and the gate of each of the electron emission elements 200 is completed.

At time t23 later than the time t22, the control signal RCONT is turned off, and the driving power source circuit 24 stops supplying the respective driving reference potentials Vs and Vi to the cathode driving circuit 21 and the gate driving circuit 22. At this time, the output of each of the cathode driving circuit 21 and the gate driving circuit 22 transitions from zero potential to a high-impedance indefinite potential state, so that the potentials between the cathodes and the gates are released from the same potential. Of course, the transition to the indefinite potential state is not essential.

The body power source 305 preferably has a charge-accumulating capacitor so that the potentials Vaa, VDD and VEE supplied from the body power source 305 decrease below the required operating potential after time t24 following the time t23.

Furthermore, at time t25 later than the time t24, the logic circuit driving potential Vcc decreases below the required operating potential, whereby a final power-off state is obtained. In addition, the cut-off control of these potentials Vaa, VDD, VEE and Vcc may also be performed with a battery and a cut-off switch in the body power source 305.

(Fourth Embodiment)

Figure 12:
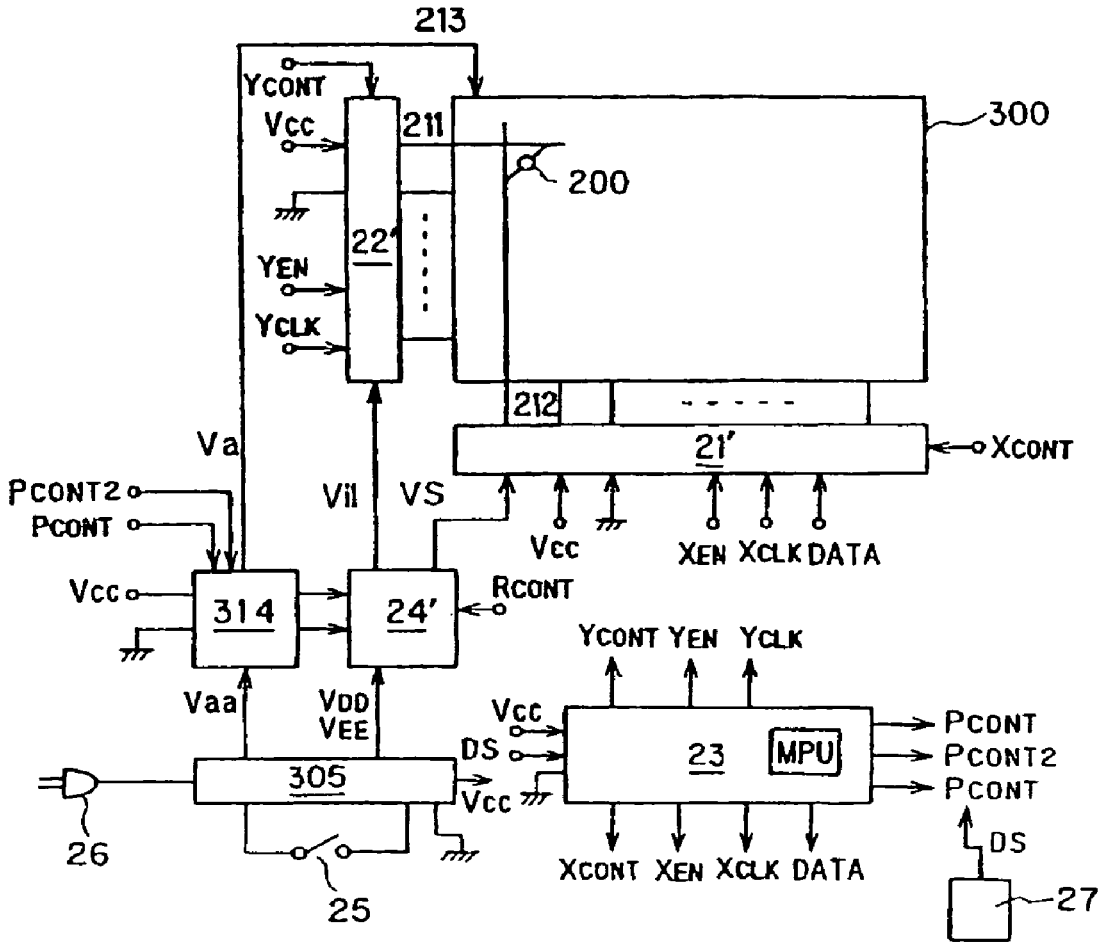
FIG. 12 is a block diagram of a driving and controlling system for a display device according to a fourth embodiment of the invention.
Figure 13:
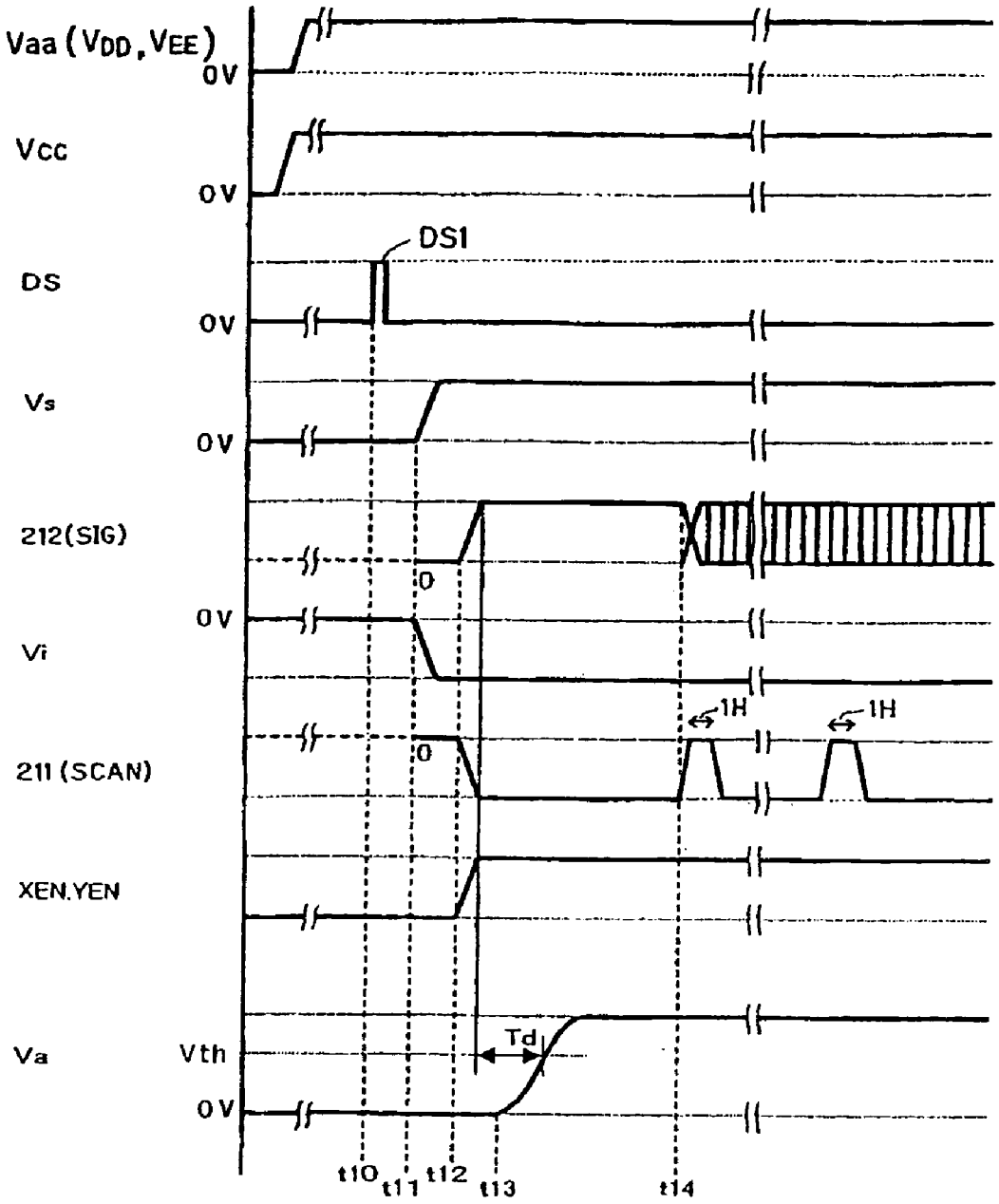
FIG. 13 is a timing chart showing a driving and controlling method for the display device according to the fourth embodiment of the invention.
Figure 14:
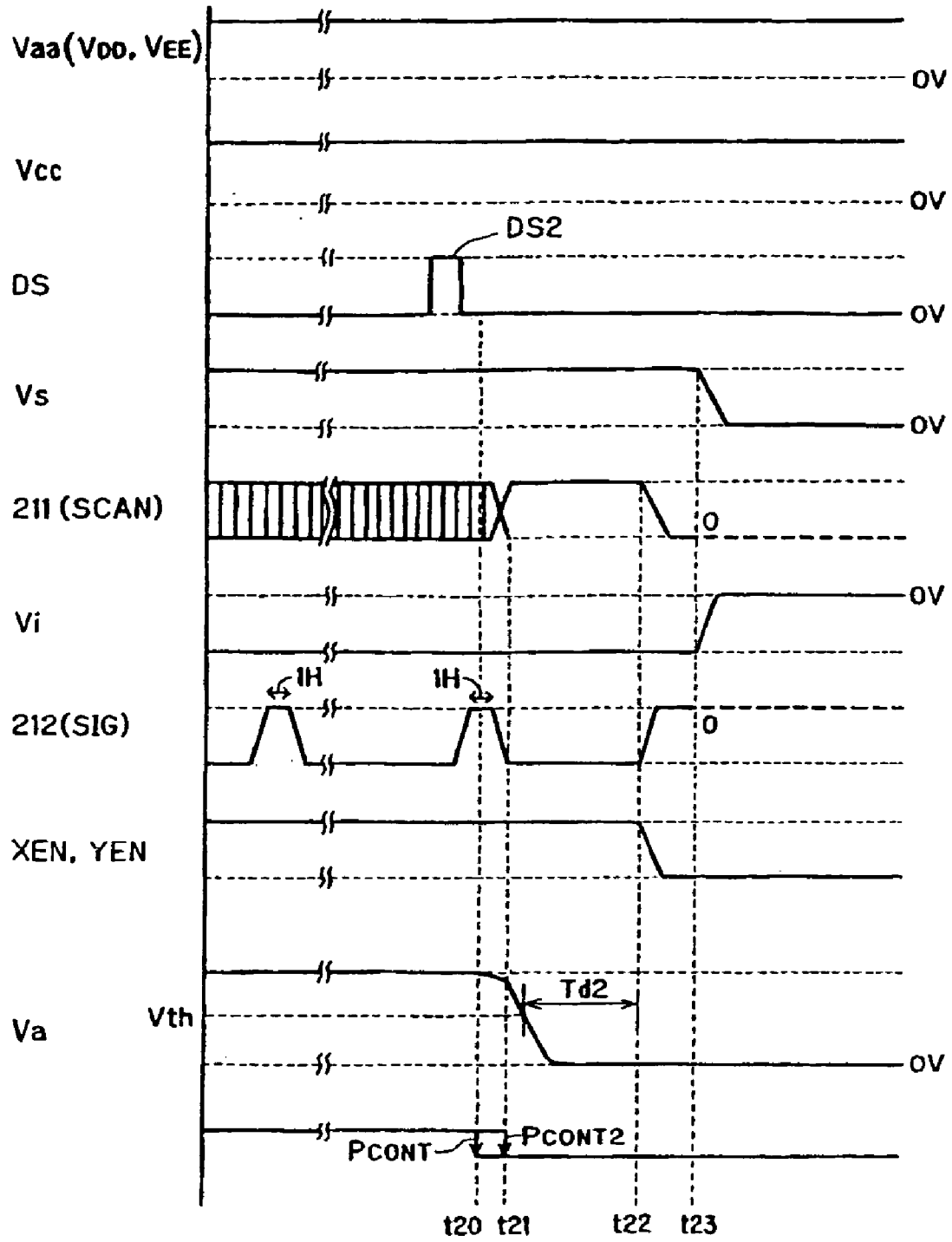
FIG. 14 is a timing chart showing a driving and controlling method for the display device according to the fourth embodiment of the invention.
Figure 15A:
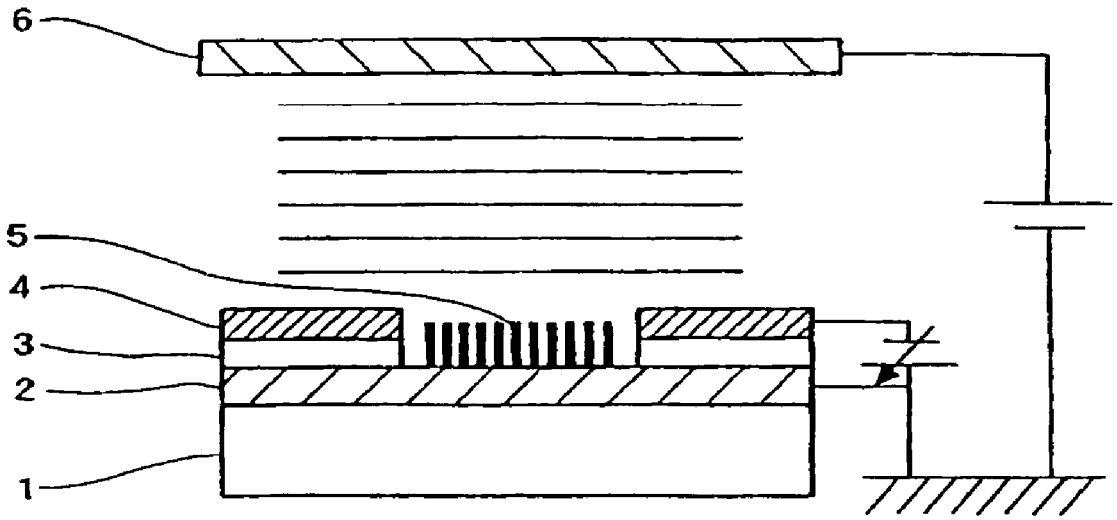
FIGS. 15A and 15B are diagrammatic views aiding in explaining the operation of an electron emission element.
Figure 15B:
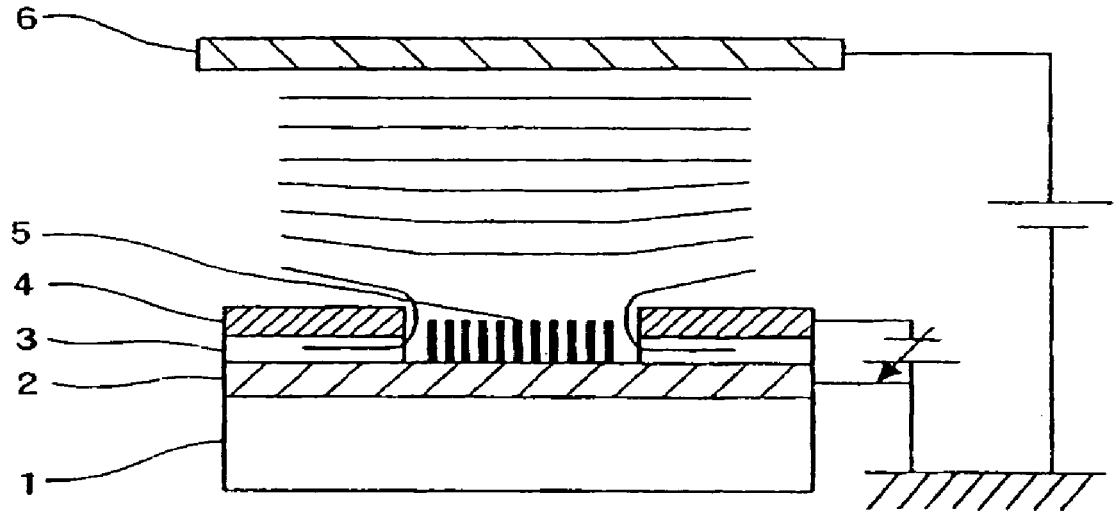

FIGS. 12 to 14 show a fourth embodiment. In the following description of the fourth embodiment, the construction of the invention using various circuits as in the third embodiment will be described in greater detail than in the above description of the first embodiment.

FIG. 12 is a block diagram showing a driving and controlling system for a display device according to the fourth embodiment of the invention. FIGS. 13 and 14 show timing charts aiding in describing a driving and controlling method for the display device according to the fourth embodiment of the invention. In the description of the fourth embodiment, a detailed description of the constructions and operations of the same constituent elements as those shown in FIGS. 5 to 7 is omitted.

The construction shown in FIG. 12 differs from that shown in FIG. 5 in that a cathode driving circuit 21' is connected to the column lines 212 and a gate driving circuit 22' is connected to the row lines 211, and in that the clock YCLK for vertical scanning, the enable signal YEN and the control signal YCONT are supplied to the gate driving circuit 22', and the clock XCLK for horizontal scanning, the enable signal XEN, the control signal XCONT and the display image data DATA are supplied to the cathode driving circuit 21', and further, in that the driving control circuit 23 is controlled wirelessly or by wire so that the display signal DS is generated from a remote controller 27 for operating the display device. It is to be particularly noted that the detailed constructions of the circuits 21' and 22' as well as a circuit 24' differ from the corresponding circuits of the above-described third embodiment.

The sequence of performing transition from a power-saving non-display mode to a display mode will first be described with reference to FIG. 13. The power-saving non-display mode is a mode in which the power source plug 26 is connected to a commercial power source and the body power source switch 25 disposed on the upstream side of power supply circuitry is on and the logic circuit driving potential Vcc is supplied to the logic circuit contained in each of the circuits.

During this non-display mode, at time t10, the display signal DS is set to a high level for the period of two system clocks by the operation of the remote controller 27 so that a display restart signal DS1 is generated and supplied to the driving control circuit 23.

The driving power source circuit 24' normally outputs zero potential, and when the input control signal RCONT is turned on at time t11, the driving power source circuit 24' starts to supply the respective driving reference potentials Vs and Vi1 to the cathode driving circuit 21' and the gate driving circuit 22'. At this time, the output of each of the cathode driving circuit 21' and the gate driving circuit 22' transitions from a high-impedance indefinite potential state to zero potential, so that the potentials between the cathodes and the gates are held at the same potential.

At time t12, when each of the enable signals XEN and YEN goes to the high level, the gate driving circuit 22' starts to supply low-voltage non-selecting potentials to all the gates (the row lines 211), and nearly at the same time, the cathode driving circuit 21' starts to supply high-voltage non-selecting potentials to all the cathodes (the column lines 212). In this manner, the cut-off voltage is applied between the cathode and the gate of each of the electron emission elements 200.

At time t13 later than the time t12, the input control signal PCONT is turned on, and the output from the anode power source circuit 314 starts transition to a high potential from a particular potential such as zero potential sufficiently lower than the threshold potential Vth capable of causing electron emission from the electron emitters.

At time t14 following the time when the anode potential Va reaches a predetermined level on the basis of the time constant of the output side of the anode power source circuit 314, the application of image-displaying driving voltages to the electron emission elements 200 at individual matrix intersections is enabled by the control signals XCONT and YCONT. Namely, the gate driving circuit 22' starts scanning, while the cathode driving circuit 21' starts to supply potentials pulse-width-modulated on the basis of the display image data DATA to the display panel 300.

In this manner, during one horizontal scanning period (1H), at least one of the row lines 211 is selected by line sequential scanning and the selecting potential (zero potential) is supplied thereto, and the non-selecting potentials (negative potentials) are supplied to the other row lines 211, and in synchronism with the supply of these potentials, the low-voltage modulated potentials pulse-width-modulated (PWM) on the basis of the display image data are supplied to the multiplicity of column lines 212. At this time, the cut-off voltage is applied between the cathode and the gate of each pixel in the non-selected scanning lines and between the cathode and the gate of each pixel in the selected scanning lines to which a modulated potential for black display data is given, whereby the corresponding pixels are brought to dark states, respectively.

The sequence of performing transition from the display mode to the power-saving non-display mode will be described with reference to FIG. 14. The power-saving non-display mode is the mode in which the power source plug 26 is connected to a commercial power source and the body power source switch 25 disposed on the upstream side of power supply circuitry is on and the logic circuit driving potential Vcc is supplied to the logic circuit contained in each of the circuits.

During the display mode, the display signal DS is set to a high level for the period of five system clocks by the operation of the remote controller 27 so that a display suspending signal DS2 which is one kind of display completing signal is generated and supplied to the driving control circuit 23. Then, at time t20, the driving control circuit 23 turns off the input control signal RCONT to be inputted the anode power source circuit 314, and performs control to stop supplying the operating voltage which becomes a source for generating the anode potential Va to the anode power source circuit 314.

Therefore, the anode potential Va starts to decrease at the time t20, but since electric charge is accumulated on the anode, the anode potential Va decreases not sharply but gradually.

Then, at time t21 which is later than the time t20 by a slight time period, the control signal PCONT2 which is being supplied from the driving control circuit 23 to the anode power source circuit 314 is turned off, and the switch 49 of the anode power source circuit 314 is turned on in response to the control signal PCONT2, whereby the anode potential Va is grounded to GND. Accordingly, at the time t21, the anode potential Va sharply decreases toward 0 V.

Until this time t21, the application of the image-displaying driving voltages to the electron emission elements 200 at individual matrix intersections by the control signals XCONT and YCONT is completed. Namely, the gate driving circuit 22' completes scanning, while the cathode driving circuit 21' stops supplying the modulated potentials based on the display image data DATA to the display panel 300.

However, even after the time t21, each of the enable signals XEN and YEN is held at the high level, and the gate driving circuit 22' starts to supply low-voltage non-selecting potentials to all the cathodes (the row lines 211), and at the same time, the cathode driving circuit 21' starts to supply high-voltage non-selecting potentials to all the gates (the column lines 212). Accordingly, the cut-off voltage continues to be applied between the cathode and the gate of each of the electron emission elements 200.

This cut-off voltage serves to prevent electron emission from occurring when the anode potential Va is in excess of the potential Vth at which an electric field strength not lower than the threshold electric field of the electron emitter 205 of the electron emission element 200 can be obtained.

Then, at time t22 until which a predetermined delay time Td2 passes after the time when the anode potential Va decreases below the potential Vth capable of causing electron emission from the electron emitters, that is to say, until which a sufficient length of time passes after the anode potential Va decreases to 0 V, each of the enable signals XEN and YEN is reset to a low level, and the gate driving circuit 22' stops supplying the low-voltage non-selecting potentials to all the cathodes (the row lines 211), and at the same time, the cathode driving circuit 21' stops supplying the high-voltage non-selecting potentials to all the gates (the column lines 212). In this manner, the application of the cut-off voltage between the cathode and the gate of each of the electron emission elements 200 is completed.

At time t22 later than the time t22 , the control signal RCONT is turned off, and the driving power source circuit 24' stops supplying the respective driving reference potentials Vi1 and Vs to the cathode driving circuit 21' and the gate driving circuit 22'. At this time, the output of each of the cathode driving circuit 21' and the gate driving circuit 22' transitions from zero potential to a high-impedance indefinite potential state, so that the potentials between the cathodes and the gates are released from the same potential. In this manner, the non-display mode is made active. Of course, the transition to the indefinite potential state is not essential.

In the above-described third embodiment, the cathodes or the gates may also be vertically scanned while the modulated potentials based on full-screen black display data being given to the gates or the cathodes as the cut-off voltage, or it is also possible to realize the cut-off voltage by continuing to give the modulated potentials based on full-screen black display data, irrespective of the selection or non-section of scanning lines. Otherwise, the non-selecting voltage may also continue to be given to all the scanning lines irrespective of the modulated potentials. In addition, the cut-off voltage may also be generated from a potential different from the potentials used for display operations, such as scanning selecting potentials, scanning non-selecting potentials or modulated potentials.

In addition, instead of continuing to apply the cut-off voltage until the time t23, it is also possible to perform application of a driving voltage capable of providing a particular display state such as full-screen gray display or cyclic image display. In this case, the cathodes or the gates are vertically scanned, and the modulated potentials based on display image data are given to the gates or the cathodes.

Furthermore, the end of display may also be provided after control passes through the state of applying the cut-off voltage by supplying modulated potentials capable of providing the darkest state to all the columns of the display panel 300 while selecting lines on a line sequential basis, after the anode potential decreases below a threshold capable of causing electron emission from the electron emitters after the time t21. Otherwise, the end of display may also be provided after control passes through the state of applying a driving voltage capable of providing a particular display state by supplying modulated potentials to a plurality of columns of the display panel 300 while selecting lines on a line sequential basis, after the anode potential Va decreases below the threshold.

The modulated potentials used in the invention may be formed by adopting, according to the display gray scale level of display image data, voltage amplitude modulation (PHM) which selects a modulated potential from among three or more potentials, pulse width modulation (PWM) which selects the pulse width of a modulated potential from among three or more pulse widths, or a modulation scheme based on a combination of PHM and PWM. In the case where a modulated potential to be supplied to either one of a cathode line and a gate line which serve as modulated signal lines is selected from among three or more potential levels, it is particularly desirable to set one of such potential levels to a potential which generates the cut-off voltage.

In addition, the cut-off voltage used in the invention may also be generated from a potential different from the potentials used for display operations, such as scanning selecting potentials, scanning non-selecting potentials or modulated potentials.

As described previously, the display signal DS is not limited to a signal indicative of the on/off state of the body power source switch disposed on the most upstream side of the display device, nor to the output signal from the remote controller for operating the display device wirelessly or by wire, and may also use at least any one of the output signals from the central operation processing part and the output signals from a computer connected to the display device. In addition, the display signal DS is preferably a reset signal from the non-display mode to the display mode or an end signal from the display mode to the non-display mode, the reset signal and the end signal being generated with at least the logic circuit driving potential Vcc supplied to the anode power source circuit, the cathode driving circuit and the gate driving circuit.

Otherwise, a reset signal from the non-display mode to the display mode or an end signal (display signal) from the display mode to the non-display mode may be used as a trigger, the reset signal and the end signal being generated with at least the driving reference potentials Vs and Vi supplied to the cathode driving circuit and the gate driving circuit, and in response to this reset signal or end signal, the enable signals XEN and YEN may be generated to enable the cathode driving circuit and the gate driving circuit and the cut-off voltage or the like may be given to these circuits.

In addition, in the non-display mode which is made active after a switch-on operation, the supplying of Vcc is maintained, but the supply of Vcc to the anode power source circuit, the cathode driving circuit and the gate driving circuit may be cut off so that the supply of Vcc may be restarted after the display signal DS is generated.

Each of the electron emission elements used in the invention which constitute the pixels may have a top gate structure in which the gate is disposed closer to the anode than to the cathode as shown, but may also have a bottom gate structure in which the cathode is disposed closer to the anode than to the gate, or a horizontal gate structure in which the cathode and the gate are disposed on the same surface of the substrate (refer to JP-A-2002-170483, U.S. Patent Laid-open No. 20020475139, JP-A-2002-150925, U.S. Patent Laid-open No. 2002074947 and the like).

It is desirable that the electron emitters used in the invention, each of which has a low electron emission threshold, use a fibrous nanostructure made of a semiconductor or a conductor, or a nanostructure mainly containing carbon. Specifically, such a nanostructure contains at least one kind selected from the group consisting of carbon nanotubes, graphite nanofibers, amorphous carbon, carbon nanohorns, graphite, diamond-like carbon, diamond and fullerene.

In this manner, according to each of the above-described embodiments, in the case where the end or suspending signal (DS) is generated by the driving control circuit 23, the operation of the display panel driving circuit is controlled so that the application of the cut-off voltage or the driving voltage capable of providing a particular display state is completed after the predetermined time Td2 passes from the time when the anode potential decreases below the threshold potential Vth capable of causing electron emission from the electron emitters when the cut-off voltage or the driving voltage capable of providing a particular display state is being applied between the cathodes and the gates, whereby it is possible to restrain the occurrence of an unsatisfactory display state and unsatisfactory luminescence.

In addition, in the case where a material having a close electron emission threshold is used, the invention can be generalized as a control method of controlling unsatisfactory electron emission even when an unexpected increase in a cathode-anode voltage occurs. Accordingly, the invention can be applied to not only the normally-on type but also a normally-off type.

EXAMPLES

Specific examples based on the above-described embodiments will be described below. Incidentally, examples of an electron emission element and a flat-panel display are approximately the same as the embodiment described in JP-A-2002-100279, and a detailed description of such examples is omitted herein and their constructions will be described below in brief.

Example 1

The display panel shown in FIG. 2 was fabricated in the following manner.

PD200 (manufactured by Asahi Glass Co. Ltd.) was employed for the electron source substrate 201. After the substrate 201 was fully cleaned to make its substrate surface clear, the cathodes 202 were formed on the substrate in continuous parallel stripes each having a thickness of about 1 μm and a width of 300 μm, by using a sputtering method and a photolithography method using an aluminum-based wiring material.

In addition, TiN was formed as an adhesive layer in portions which constituted the respective electron emitters 205 on each of the cathodes 202, and Pd/Co (50 weight % each substance) was formed on the TiN layer as a catalytic layer. Either of the layers was formed to have a size of ϕ 100 μm, by using a sputtering method and a photolithography method. Incidentally, the catalytic layer may also use Fe or Ni or a mixture of Fe or Ni and the aforesaid Pd or Co.

SiO2 was formed to a thickness of about 2 μm as an interlayer insulating layer on the catalytic layer in portions except the electron emitters 205, by using a sputtering method and a photolithography method.

Furthermore, similarly to the cathodes 202, the gates 204 each having a thickness of about 0.5 μm and a width of 200 μm were formed on the interlayer insulating layer in continuous parallel stripes in such a manner as to cross the cathodes 202 at right angles.

In addition, the hole portions 210 each having an opening diameter of ϕ 10 μm were formed in each of the gates 204 at positions directly above the respective electron emitters 205.

Incidentally, regarding the electron emitters 205 and the hole portions 210, one electron emitter and one hole portion are shown in each of the electron emission elements 200, but a plurality of electron emitters and hole portions may also be provided.

Then, after Pd and Co were individually oxidized by treating this electron source substrate 201 by heating in the atmosphere, the electron source substrate 201 was put into a CVD system, and heat treatment was performed while hydrogen was being fed into the CVD system, whereby hydrogen reduction was performed on palladium oxide and cobalt oxide to form these substances into particles.

After that, heat treatment was performed at 550° C. for one hour while ethylene was being fed into the CVD system. Specifically, a graphite nanofiber (GNF) having a structure in which a multiplicity of graphenes were laminated in the longitudinal direction of fiber was formed on the adhesive layer of TiN through the action of a catalyst by thermal CVD. Incidentally, a hydrocarbon gas such as acetylene or methane can also be used in place of ethylene, and similar GNFs can be formed by suitably selecting factors such as gas flow rate, temperature and time.

The electron source substrate 201 formed in this manner and the faceplate 206 and the external frame 214 both of which were previously formed by using the same PD200 were heated at 400° C. by using a grass flit in a vacuum chamber evacuated to a pressure of $10^{-7}$ Pa or less, thereby forming a vessel.

During this time, spacers (not shown) were arranged in the X direction on the electron source substrate 201 to form an atmospheric pressure supporting structure, and the electron source substrate 201 and the anode (the metal back 209) of the faceplate 206 were held in opposition to each other with a space of 2 mm interposed therebetween by means of the external frame 214 and the spacers.

The cathodes 202 and the gates 204 of the display panel prepared in this manner were set to 0 V, and the anode potential Va was applied to the anode and was gradually increased. Consequently, it was confirmed that electron emission was started at Va=7 kV (the electron emission threshold voltage between the cathodes 202 and the anode) and the phosphor layer 208 of the faceplate 206 emitted light. It was also found out that the threshold electric field strength of the electron emission elements 200 was approximately 3.5 V/μm. By further increasing the anode potential Va up to Va=10 kV, the electric field strength between the cathodes 202 and the anode was set to 5 V/μm to enable the electron emission elements 200 to operate positively as the normally-on type ones.

To find out the cut-off voltage between the cathode 202 and the gate 204 of each of the electron emission elements 200 fabricated in this manner, the potential Vx to be supplied to the row lines 211 serving as the cathodes 202 was held at 0 V, while the potential Vy to be supplied to the column lines 212 serving as the gates 204 was gradually supplied. Consequently, electron emission was able to be cut off at Va=10 kV with Vy=−50 V. Namely, it was found out that the cut-off voltage between the cathode 202 and the gate 204 was −50 V (a gate voltage, when 0 V was set on the cathode side).

Then, in the above-described display panel 300, a driver IC including an integrated scanning signal applying circuit was mounted on a printed circuit board as the scanning signal applying unit 301 for the X-directional lines 211, and the driver IC and the X-directional lines 211 were interconnected by a flexible printed circuit board. Similarly, the modulated signal applying unit 302 was connected to the Y-directional lines 212.

In addition, the signal required to generate scanning signals and that required to generate modulated signals were respectively connected from the control circuit 303 to the scanning signal applying unit 301 and the modulated signal applying unit 302, and a signal line for controlling the operation of the anode power source circuit 304 was also connected from the control circuit 303.

The body power source 305 for supplying the voltages required for the operations of these control circuit 303 and anode power source circuit 304 was connected to each of them.

Although not shown, in addition to the above-described circuits, the signal processing circuits and peripheral circuits that were required for image display were connected in a similar manner.

The control circuit 303 was provided with a microcomputer IC, and was used for the various kinds of signal processing required for power-off sequence, image display and others, or for the control of the functions (for example, a remote control function) required for a television system.

As shown in the timing chart of the power-off sequence of FIG. 1, when the power source was turned off, the display signal DS went to a low level in the control circuit 303, and the required signal processing, power source voltage control and the like (not shown) were performed by the microcomputer IC, and after that, a control signal was sent to the anode power source circuit 304 from the control circuit 303 to turn off Va=10 kV.

Incidentally, in this example, since Vth=7 kV as described previously, after the anode potential Va decreased below 7 kV, in order to make the time Td2 50 ms in this example, control signals were respectively sent from the control circuit 303 to the scanning signal applying unit 301 and the modulated signal applying unit 302 so that Vx and Vy were individually cut off, whereby the driver IC stopped the application of Vx and Vy. Incidentally, Vx and Vy at this time were general display signals, and a scanning signal and a modulated signal continued to be applied as Vx and Vy, respectively.

As described above, in the power-off sequence, after the application of the anode potential Va to the normally-on type electron emission elements was stopped and the anode potential Va decreased below the threshold potential Vth of the electron emission elements, the voltages between the cathodes 202 and the gates 204 were cut off. Accordingly, display was able to be completed without causing displeasure due to full-screen white display during a power-off operation or a power failure.

Example 2

A display device was prepared on the basis of the block diagram shown in FIG. 4, by using the normally-on type display panel 300 fabricated as Example 1.

In Example 2, the cut-off grounding circuit 306 was provided between the anode power source circuit 304 and the high-voltage terminal 213 of the display panel 300.

In the above-described construction, when a decrease in power source voltage was detected, the display signal DS was reset to the low level in the control circuit 303, and after the control circuit 303 sent a signal to the cut-off grounding circuit 306 and cut off the supply of a high potential, the high-voltage terminal 213 was grounded to cause the accumulated electric charge of the anode to be discharged to GND, thereby reducing the anode potential Va to the threshold potential Vth or less.

After that, Vx and Vy were cut off with Td2=50 ms in accordance with the power-off sequence shown in FIG. 1.

Since Example 2 was constructed so that the anode potential Va could be reduced to the threshold potential Vth or less as rapidly as possible, the power-off sequence was able to be executed far more rapidly.

Example 3

Similarly to Example 1, carbon nanotubes (CNT) having a structure in which graphene was cylindrical were formed as the electron emitters 205 by a well-known method by suitably selecting the conditions of a catalyst layer and thermal CVD, whereby electron emission elements of threshold electric field strength about 3.5 V/μm were obtained.

Similarly to Example 1, normally-on type electron emission elements were obtained by the application of Va=10 kV, and the cathode-gate cut-off voltage at that time was confirmed to be approximately −50 V.

In this Example 3 as well, in the power-off sequence, full-screen white display was prevented from occurring during power-off operation.

As is apparent from the foregoing description, the invention is capable of preventing unsatisfactory display such as full-screen white in the case where the anode potential is made to transition from a supply state to a cut-off state according to the occurrence of a display completing signal during a power-off operation or the like. Namely, it is possible to prevent a phenomenon which may be mistaken for a failure of the display device by a user or may displease the user even for a short time.

What is claimed is:

1. A display device comprising:

a display panel having cathodes, gates and an anode, the cathodes and the gates being connected in matrix form;

electron emitters provided on each of the cathodes and capable of performing electron emission with a voltage applied only between the cathodes and the anode, the display device being constructed to perform display by bringing pixels to dark states by applying a cut-off voltage between the cathodes and the gates to cut off electron emission from the electron emitters toward the anode; and a control unit for controlling the operation of a display panel driving circuit in order to complete, when a display completing signal is generated, application of the cut-off voltage or a driving voltage capable of providing a particular display state, after a predetermined time passes from the moment when a potential of the anode decreases below a threshold potential capable of causing electron emission from the electron emitters with the cut-off voltage or the driving voltage capable of providing the particular display state being applied between the cathodes and the gates.

2. A display device according to claim 1, wherein the application of the cut-off voltage or the driving voltage capable of providing the particular display state between the cathodes and the gates is simultaneously performed on all pixels of the display panel.

3. A display device according to claim 1, wherein the cut-off voltage or the driving voltage capable of providing the particular display state is applied between the cathodes and the gates by supplying a scanning selecting potential to at least one row of scanning lines of the display panel while supplying a scanning non-selecting potential to the other rows of the scanning lines, and supplying modulated potentials capable of generating darkest states or a predetermined potential to all columns of modulated signal lines of the display panel in synchronism with the scanning non-selecting potential.

4. A display device according to claim 1, wherein the display panel driving circuit includes:

an anode power source circuit for supplying the anode potential;

a cathode driving circuit for driving the cathodes;

a gate driving circuit for driving the gates; and a driving power source circuit for supplying a driving reference potential for generating the cut-off voltage or the driving voltage capable of providing the particular display state, to the cathode driving circuit and the gate driving circuit.

5. A display device according to claim 4, wherein the cathode driving circuit and the gate driving circuit completes the application of the cut-off voltage or the driving voltage capable of providing the particular display state, with a logic circuit driving potential supplied to the cathode driving circuit and the gate driving circuit, and subsequently the driving power source circuit completes the supply of the driving reference potential.

6. A display device according to claim 4, wherein during a period within which the application of the cut-off voltage or the driving voltage capable of providing the particular display state is completed, the anode power source circuit holds the anode at a particular potential sufficiently lower than the threshold potential capable of causing electron emission from the electron emitters with a logic circuit driving voltage applied to the anode power source circuit.

7. A display device according to claim 4, wherein the application of the cut-off voltage or the driving voltage capable of providing the particular display state is completed after the application of an image-displaying driving voltage based on input display image data from the cathode driving circuit and the gate driving circuit to the display panel is completed.

8. A display device according to claim 1, wherein the voltages between the cathodes and the gates are made to transition to zero after the application of the cut-off voltage or the driving voltage capable of providing the particular display state is completed.

9. A display device according to claim 1, wherein the cut-off voltage or the driving voltage capable of providing the particular display state is applied between the cathodes and the gates by supplying a scanning non-selecting potential capable of applying the cut-off voltage, to either cathode lines or gate lines which serve as scanning lines in the display panel, irrespective of potentials of the other lines which serve as modulated signal lines, or by supplying the cut-off voltage or modulated potentials capable of applying a driving voltage capable of providing the particular display state, to either cathode lines or gate lines which serve as modulated signal lines, irrespective of potentials of the other lines which serve as scanning lines.

10. A display device according to claim 1, wherein modulated potentials to be supplied to either one of cathode lines or gate lines which serve as modulated signal lines in the display panel are potentials selected from three or more levels, two or more of the modulated potentials being potentials each of which generates a driving voltage capable of emitting electrons by being supplied in synchronism with a scanning selecting potential, one of the modulated potentials being a potential which generates the cut-off voltage.

11. A display device according to claim 1, wherein each of the electron emitters is a fibrous nanostructure made of a semiconductor or a conductor or a nanostructure mainly containing carbon.

12. A display device according to claim 11, wherein the nanostructure includes at least one kind selected from the group consisting of carbon nanotubes, graphite nanofibers, amorphous carbon, carbon nanohorns, graphite, diamond-like carbon, diamond and fullerene.

13. A driving and controlling method for a display device which includes:

a display panel having cathodes, gates and an anode, the cathodes and the gates being connected in matrix form;

electron emitters provided on each of the cathodes and capable of performing electron emission with a voltage applied only between the cathodes and the anode, the display device being constructed to perform display by bringing pixels to dark states by applying a cut-off voltage between the cathodes and the gates to cut off electron emission from the electron emitters toward the anode, the driving and controlling method comprising:

an anode potential supply stopping step of decreasing, when a display completing signal is generated, a potential of the anode to a potential below a threshold potential capable of causing electron emission from the electron emitters with the cut-off voltage or the driving voltage capable of providing a particular display state being applied between the cathodes and the gates; and an application stopping step of stopping the application of the cut-off voltage or the driving voltage capable of providing the particular display state, after a predetermined time passes from the moment when the anode potential supply stopping step is performed.

14. A driving and controlling method for a display device according to claim 13, wherein the driving power source circuit holds the anode at a potential sufficiently higher than the threshold potential capable of causing electron emission from the electron emitters, and stops the application of the image-displaying driving voltage based on the input display image data from the cathode driving circuit and the gate driving circuit to the display panel, then performs the anode potential supply stopping step and, during an end period of the anode potential supply stopping step, the cathode driving circuit and the gate driving circuit continue to apply the cut-off voltage or the driving voltage capable of providing the particular display state between the cathodes and the gates, with a logic circuit driving potential supplied to the cathode driving circuit and the gate driving circuit, and subsequently stops the application of the cut-off voltage or the driving voltage capable of providing the particular display state between the cathodes and the gates, in the state of holding the anode at a particular potential sufficiently lower than the threshold potential capable of causing electron emission from the electron emitters.

* * * * *

UNITED STATES PATENT AND TRADEMARK OFFICE

CERTIFICATE OF CORRECTION

PATENT NO. : 7,145,528 B2
APPLICATION NO. : 10/716664
DATED : December 5, 2006
INVENTOR(S) : Shigeki Yabu et al.

It is certified that error appears in the above-identified patent and that said Letters Patent is hereby corrected as shown below:

COLUMN 1:
Line 32, "(1965)" should read --(1965).--.

COLUMN 9:
Line 55, "stop state" should read --stop state.--.

COLUMN 17:
Line 1, "t22 later" should read --t23 later--.

COLUMN 19:
Line 31, "SiO2" should read --$SiO_2$--.

COLUMN 20:
Line 2, "grass" should read --glass--.

Signed and Sealed this

Sixth Day of November, 2007

JON W. DUDAS
*Director of the United States Patent and Trademark Office*